US007107630B2

(12) United States Patent
Noro et al.

(10) Patent No.: US 7,107,630 B2
(45) Date of Patent: Sep. 19, 2006

(54) BATHING AID

(75) Inventors: Masaru Noro, Moriguchi (JP); Masafumi Nishino, Moriguchi (JP); Tetsunari Hamada, Moriguchi (JP)

(73) Assignees: Sanyo Electric Co., Ltd., Osaka (JP); Sanyo Electric Techno Clean Co., Ltd., Osaka (JP)

( * ) Notice: Subject to any disclaimer, the term of this patent is extended or adjusted under 35 U.S.C. 154(b) by 300 days.

(21) Appl. No.: 10/637,607

(22) Filed: Aug. 11, 2003

(65) Prior Publication Data

US 2004/0078888 A1 Apr. 29, 2004

(30) Foreign Application Priority Data

Aug. 26, 2002 (JP) ..... 2002-244662

(51) Int. Cl.
*A47K 3/02* (2006.01)

(52) U.S. Cl. ..... 4/556; 4/540; 4/555; 4/560.1; 4/554

(58) Field of Classification Search ..... 4/540, 4/554, 555, 556, 559, 560.1, 561.1, 562.1, 4/563.1

See application file for complete search history.

(56) References Cited

U.S. PATENT DOCUMENTS 4,432,104 A * 2/1984 Sasaki ..... 4/555
5,393,119 A * 2/1995 Mukai ..... 4/540
5,722,099 A * 3/1998 Suzuki et al. ..... 4/555
6,076,203 A * 6/2000 Karhumaki ..... 4/540
2004/0034917 A1* 2/2004 Noro et al. ..... 4/540

FOREIGN PATENT DOCUMENTS

JP B2 2628568 4/1997
JP A 2000-116745 4/2000
JP 2001037843 A * 2/2001
JP 2003275120 A * 9/2003

* cited by examiner

*Primary Examiner*—Khoa D. Huynh
(74) *Attorney, Agent, or Firm*—Oliff & Berridge, PLC

(57) ABSTRACT

A bathing aid is designed to reduce the workload on the caregiver in bathing the physically challenged, elderly or similar persons requiring nursing care. The bathing aid is provided with an upward-opening cover for covering the open top of the bathtub except for an opening for allowing the bather to stick their head through. The cover is supported by arms urged upward by gas springs. The upward-opening cover allows the caregiver to stand whichever side of the bathtub and opens or closes the cover without difficulty. Furthermore, the cover's upward-opening structure is advantageous for reducing the installation space because it does not require the additional side space that would be necessary if the cover is constructed to open sideward.

8 Claims, 25 Drawing Sheets

[REGULATING TEMPERATURE OF HOT WATER SUPPLIED THROUGH THE BYPASS PIPE]

BATHING AID

The present invention relates to a bathing aid for assisting the physically challenged, elderly or similar persons requiring nursing care for being bathed by a caregiver.

BACKGROUND OF THE INVENTION

Various types of bathing aids have been developed for those who have difficulty in standing up and/or bathing by themselves. Those people include the physically challenged, elderly and invalids, who are generally called "cared persons" hereinafter. Some bathing aids are constructed so that the cared person sitting on a wheelchair can be easily transferred from the wheelchair into a bathtub, into which hot water can be supplied.

An example of such bathing aids is disclosed in the Japanese Patent No. 2,628,568. The bathing aid includes a bathtub capable of rotating from a horizontal position where the open top of the bathtub is directed almost upward to a tilted position where its open top is obliquely directed. In the latter position, the front end of the bathtub is located close to the floor. In this position, the bathtub can be locked, allowing the cared person to be slid from the wheelchair into the bathtub, together with the seat unit. After receiving the cared person inside, the bathtub is unlocked, rotated to the horizontal position, and again locked in that position. Then, hot water is supplied into the bathtub to let the cared person bathe in a supine position.

The general situation of nursing care is such that caregivers have to do many jobs that require physical exertion, especially when they assist the cared person in taking a bath, as described above. Therefore, it has been desired to reduce the workload on the caregiver, especially when the work requires physical strength.

In the aforementioned conventional bathing aid, the seat unit of the wheelchair can be slid into the bathtub, as described above, so that the heavy work of manually lifting the cared person and setting her or him into the bathtub is eliminated, and the workload on the caregiver is reduced. For those who are weak in physical strength, however, it is not easy to rotate the bathtub with the cared person inside. Furthermore, it is necessary to transport the bathtub with the cared person into the bathroom to supply hot water into the bathtub. Therefore, to assist the cared person in bathing, the caregiver still has to use a considerable amount of time and labor.

In the bathing aid disclosed in the Japanese Unexamined Patent Publication No. 2000-116745, a commercial product of which is the "CHAIR IN BATH" manufactured by OG GIKEN CO., LTD., the bathtub has a door on one side of its body, and the wheelchair can be separated into the seat unit and the bogie unit. With the door of the bathtub open, when the wheelchair carrying the cared person is pushed close to the bathtub and brought into contact with the bathtub, the seat unit carrying the cared person slides into the bathtub, leaving the bogie unit below the bottom of the bathtub, i.e. in the outside of the bathtub. After that, the door is closed, and hot water is supplied into the bathtub to let the cared person bathe.

The above bathing aid is integrated with a water supply system, which to some extent reduces the workload on the caregiver. However, the above bathing aid is large-sized and requires a sizeable installation space because it is designed for use in nursing care facilities or similar facilities where the installation space can be easily located. Therefore, it is very difficult to install the above bathing aid in ordinary houses for home nursing care. Thus, people have been demanding for a small-size bathing aid that occupies only a limited space and can be used even in an ordinary house. The reduced size will be advantageous also for nursing care facilities because it allows them to use plural sets of bathing aids.

The inherent purposes of bathing aids are to keep the body of the cared person clean, to let the cared person feel relaxed and refreshed by bathing so that she or he can be in good mental condition, and sometimes to expect curative effects on the body from heating or other treatment. In respect of such inherent purposes, it is important to obtain better effects than conventionally obtained.

Cared persons who use the bathing aid may often have difficulty in moving by themselves, or sometimes in speaking by themselves. Therefore, with respect to safety, adequate measures are necessary to protect the cared person from dangerous situations during bathing so that the cared person can feel safe in bathing.

The present invention addresses the above problems, and the first objective of the invention is to provide a user-friendly bathing aid that reduces the workload on caregivers and can be easily operated even by those who are relatively small in body size and/or weak in physical strength.

The second objective of the present invention is to provide a bathing aid that requires only a small installation space.

The third objective of the present invention is to provide a bathing aid that offers high safety to the cared person, i.e. the bather.

The fourth objective of the present invention is to provide a bathing aid that enables the cared person to have a good feeling of satisfaction and safety, thus providing high bathing effects, and that offers high safety to the cared person, i.e. the bather.

SUMMARY OF THE INVENTION

To solve the above problem, the present invention provides, as the first invention, a bathing aid, which includes:

a wheelchair separable into a seat unit for a bather to sit down on and a bogie unit located under the seat unit;

a bathtub having an open top for receiving the seat unit with the bather sitting thereon; and an upward-opening cover for closing the open top of the bathtub except for an opening for allowing the bather to stick the head through;

whereby the seat unit of the wheelchair with the bather sitting thereon is transferred through the open top into the bathtub with the cover opened, and then hot water is supplied into the bathtub so that a part of the body of the bather is submerged under the hot water.

To use the bathing aid according to the present invention, the cover is opened upward, and then the seat unit with the bather sitting thereon is slid from the bogie unit into the bathtub. After the bather is set in the bathtub, the cover is lowered to close the open top of the bathtub. There, a part of the open top is left open, through which the bather can stick their head to the outside. The shoulders of the bather may also stick out if the body size of the bather is relatively large. Then, hot water is supplied into the bathtub so that a part of the body is submerged under the hot water.

In the bathing aid according to the first invention, the cover is constructed to open upward. Constructing the cover to open sideward is not recommendable because, if the caregiver stands on the side opposite to the cover, the caregiver must lean over the bathtub to reach for the cover and close it, which may be difficult for those who are relatively short. In addition, both the caregiver and the bather may feel uncomfortable in the case where the caregiver leans over the bather. In the bathing aid according to the first invention, the upward-opening cover allows the caregiver to stand on whichever side of the bathtub and open or close the cover without difficulty. In opening or closing the cover, the caregiver does not need to lean over the bather in the bathtub, so that neither the caregiver nor the bather feels any misgivings about the operation. Furthermore, the cover's upward-opening structure is advantageous for reducing the installation space because it does not require the additional side space that would be necessary if the cover is constructed to open sideward.

To solve the above problem, the present invention provides, as the second invention, a bathing aid, which includes:

a wheelchair separable into a seat unit for a bather to sit down on and a bogie unit located under the seat unit;

a bathtub having an open top for receiving the seat unit with the bather sitting thereon and a drainage port for draining hot water from the bathtub;

a cover for closing the open top of the bathtub except for an opening for allowing the bather to stick the head through; and an overflow prevention mechanism having an overflow port located on a surface of the cover facing the bathtub, a cover-side overflow pipe extending from the overflow port through the body of the cover, and a bathtub-side overflow pipe, one end of which is connected to the cover-side overflow pipe when the cover is closed and the other end of which leads to either the drainage port or an external drainage pipe.

In the bathing aid according to the second invention, when the hot water in the bathtub exceeds a predetermined level, the excessive portion of the hot water enters the overflow port formed on the cover, then flows through the cover-side overflow pipe and the bathtub-side overflow pipe to the drainage port of the bathtub or an external drainage pipe, and is finally discharged to the outside. Therefore, even if too much water is supplied into the bathtub or the water rises to an abnormally high level due to a motion of the body of the bather or a movement of the bathtub, the hot water will never spill over onto the floor. It is of course possible to provide another overflow port on the inner wall of the bathtub in addition to the overflow port formed on the cover.

To solve the above problem, the present invention provides, as the third invention, a bathing aid, which includes:

a wheelchair separable into a seat unit for a bather to sit down on and a bogie unit located under the seat unit;

a bathtub having an open top for receiving the seat unit with the bather sitting thereon;

a bathtub actuator having a motor, a vertical screw shaft rotated by the motor, and a movable unit having a ball screw engaged with the screw shaft and vertically moving with the rotation of the screw shaft; and a bathtub supporter having a supportive shaft mounted on the movable unit for supporting the rear part of the bathtub, a wheel located under the bottom of the bathtub at a position closer to the front than the supportive shaft, and a guide slope descending frontward, on which the wheel runs, whereby a vertical motion of the movable unit in the bathtub actuator produces a vertical motion of the rear end of the bathtub through the supportive shaft, with the wheel moving up or down along the guide slope, which changes the orientation of the bathtub so that the direction of the open top changes between an upward direction and a frontward direction.

In the bathing aid according to the third invention, when the screw shaft is rotated in a predetermined direction, the movable unit moves downward due to the action of the ball screw, pushing down the rear end of the bathtub through the supportive shaft. Then, the wheel located under the bottom of the bathtub runs down the guide slope, and the bathtub gradually changes its orientation from a position where the open top is directed frontward to a position where the open top is directed upward. When the screw shaft is rotated in the opposite direction, the movable unit moves upward, and the bathtub gradually changes its orientation from the position where the open top is directed upward to the position where the open top is directed frontward. When the motor is stopped with the movable unit located at the position, the engagement between the screw shaft and the ball screw securely holds the movable unit at the position.

Thus, the bathtub can be securely held at any tilted angle with a high level of safety and reliability; the bathtub will never accidentally fall, as long as there is no such abnormally strong force that deforms the thread of the screw shaft or breaks the ball screw. Since the operation of bringing the movable unit from moving state into halted state, or vice versa, is smoothly performed, the bather experiences only a slight shock during the process of changing the orientation of the bathtub with the bather inside. Thus, the bather will never feel uneasy.

The bathing aid according to the third invention may be preferably constructed so that the wheel is located inward of either sidewall of the bathtub.

This construction makes it possible to employ the wheel without increasing the installation space necessary for the apparatus, because the wheel is located inward of either sidewall of the bathtub.

In the bathing aid according to the third invention, the motor may be used to bring the bathtub into one of three states including: a storage state where the open top of the bathtub is directed almost frontward; a setting state where the front edge of the bathtub is located close to the floor and the open top of the bathtub is directed obliquely frontward, allowing the bather to be transferred into or out of the bathtub; and a normal bathing state where the open top of the bathtub is directed almost upward.

This construction makes it possible to use only one motor as a power source to change the orientation of the bathtub according to the following objectives: storing the bathtub; transferring the bather into or out of the bathtub; or bathing. Use of a single motor not only simplifies the construction of the apparatus and accordingly reduces the production cost, but also increases the reliability of the apparatus.

To solve the above problem, the present invention provides, as the fourth invention, a bathing aid, which includes:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an expansible bogie-fastening element to which a predetermined part of the bogie unit is fastened for temporarily fixing the bogie unit, which element changes its position with the motion of the bathtub so that it retreats backward when the bathtub is moved toward an upright position while it expands forward when the bathtub is pushed forward;

whereby the bathtub has a wheel located under the bottom thereof that runs when the bathtub changes its orientation, and the bogie-fastening element expands forward when the wheel comes onto the bogie-fastening element and exerts a pressure thereon from above, whereas the bogie-fastening element stands up and retreats backward when it is released from the pressure exerted the wheel.

In the bathing aid according to the fourth invention, the orientation of the bathtub is changed with the bathtub supporter so that the bathtub is pushed forward until it reaches a predetermined position where the wheel of the bathtub presses the bogie-fastening element from above to make it expand forward. Then, with the bathtub held at this position, the caregiver pushes the wheelchair with a bather sitting thereon toward the bathtub until the predetermined part of the bogie unit is fastened to the bogie-fastening element. After fastening the bogie unit to the bogie-fastening element, the caregiver slides the seat unit into the bathtub with the bather sitting thereon, while leaving the bogie unit in the fastened position. Thus, with the bogie unit securely fastened to the bathtub, the bather can be safely transferred into the bathtub. This security is also ensured when the bather is transferred from the bathtub back to the bogie unit after bathing. When the bathtub is in the upright position, the bogie-fastening element is released from the pressure exerted by the wheel of the bathtub, and retreats backward. In the retreated state, the bogie-fastening element will never be obstructive to the caregiver or other person because it is not extending frontward. Furthermore, the retreated state reduces the space necessary for storing the apparatus when the apparatus is not being used.

To solve the above problem, the present invention provides, as the fifth invention, a bathing aid, which includes:

a wheelchair separable into a seat unit for a bather to sit down on and a bogie unit located under the seat unit, and a bathtub having an open top for receiving the seat unit with the bather sitting thereon, whereby the seat unit of the wheelchair with the bather sitting thereon is transferred into the bathtub, and then hot water is supplied into the bathtub, wherein the seat unit has a first wheel running on a bogie-side guide rail located in the bogie unit and a second wheel running on a bathtub-side guide rail located in the bathtub, where the first wheel is free from contact with the bathtub-side guide rail and the second wheel is free from contact with the bogie-side guide rail.

In general, wheelchairs are composed of various parts made of stainless steel, aluminum or other metal so that they have adequate strength, whereas bathtubs are made of synthetic resins, such as fiber-reinforced plastics, to reduce their weight and improve their heat-retaining property. Therefore, in a bathing aid that has a wheelchair having a seat unit to be transferred into or out of a bathtub, the seat unit needs to run on two types of guide rails made of different materials. According to the fifth invention, the first wheel running on the bogie-side rail and the second wheel running on the bathtub-side rail are separately provided, and the first wheel is free from contact with the bathtub-side guide rail, whereas the second wheel is free from contact with the bogie-side guide rail. This construction allows both wheels to be made of different materials suitable for the materials of the corresponding rails. The selection of suitable materials for the wheels will improve the durability of the wheels and the rails, and provide a high degree of reliability. Furthermore, noises that result from the friction between the wheels and the rails will be reduced. This reduction of noise will provide more comfortableness to the caregiver and bather.

The bathing aid according to the fifth invention may be constructed so that the bogie-side guide rail has two cylindrical rail elements, one located parallel to and above the other, the first wheel is composed of a disk-shaped core clamped by an outer and inner disks each having a diameter greater than that of the core, and when the first wheel runs on the bogie-side guide rail, the core rolls in the space between the two rail elements, with the outer and inner disks clamping the two rail elements from both sides.

This construction assuredly supports the seat unit on the bogie unit of the wheelchair and reduces the vertical or horizontal shakes of the seat unit, while allowing the sliding motion of the seat unit. Thus, the bather can feel secure.

The bathing aid according to the fifth invention may be preferably constructed so that the bogie-side guide rail has a surface for the first wheel to run on, and an end part of the surface has an inclined profile that descends toward the end of the rail to be pointed to the bathtub when the bather is transferred into the bathtub.

This construction provides a smooth transition of the seat unit across the bogie unit and the bathtub and reduces the shock that the bather sitting on the seat unit may feel when the first wheel leaves the bogie-side guide rail or lands onto the bogie-side guide rail. Thus, the bather can feel secure.

To solve the above problem, the present invention provides, as the sixth invention, a bathing aid, which includes:

a wheelchair separable into a seat unit for a bather to sit down on and a bogie unit located under the seat unit;

a bathtub having an open top for receiving the seat unit with the bather sitting thereon;

a tank, located above the bathtub, for storing hot water to be supplied into the bathtub, a water supply pipe connecting the tank and the bathtub, where the water supply pipe is provided with a water supply valve having a first valve body; and a drainage pipe, an end of which is connected to the tank for draining hot water from the tank, where the drainage pipe is provided with a drainage valve having a second valve body, whereby either one or both of the first valve body and the second valve body open or close either or both of an inlet of the water supply pipe and an inlet of the drainage pipe as the one or both of the first valve body and the second valve body are submerged underwater in the tank.

In the bathing aid according to the fifth invention, the hot water to be supplied into the bathtub is stored in the tank. When the water supply valve is opened, the hot water is supplied through the water supply pipe into the bathtub. When the drainage valve is opened, the hot water in the tank is discharged through the drainage pipe. According to the fifth invention, one or both of the two valves is installed in the tank. For example, the water supply valve may have a valve body in the tank, which opens or closes the inlet of the water supply pipe as it is submerged underwater. The valve body can be lifted by the driving force of the motor so that the inlet is opened. When the driving force is stopped, the valve body is pressed onto the inlet by water pressure. This construction efficiently uses the space by eliminating the additional space required for installing a valve outside the tank. The drainage valve may be similarly installed in the tank in place of, or in addition to, the water supply valve. It should be noted that installation of the water supply valve in the tank is recommendable to reduce the waiting time for the bather, because the construction leaves more space outside the tank and allows the water supply pipe to have a larger diameter so that the hot water can be supplied from the tank into the bathtub in a shorter period of time.

To solve the above problem, the present invention provides, as the seventh invention, a bathing aid, which includes:

a wheelchair separable into a seat unit for a bather to sit down on and a bogie unit located under the seat unit;

a bathtub having an open top for receiving the seat unit with the bather sitting thereon;

a water supplier for supplying hot water into the bathtub;

an input device for allowing a caregiver to choose the use of a liquid agent including a bath agent and/or a cleaning agent during bathing; and a liquid injection mechanism having a container for storing the liquid agent beforehand and a liquid injector for injecting the liquid agent taken from the container into the hot water when the water supplier supplies the hot water into the bathtub and the use of the liquid agent is ordered through the input device.

To use the bathing aid according to the seventh invention, the caregiver should put a liquid agent, such as a bathing aid and/or a cleaning agent (e.g. bath soap solution), in the container beforehand. When the water supplier supplies hot water into the bathtub, the agent injector automatically takes in the liquid agent from the container and injects it into the hot water, if the use of the liquid agent is directed. Thus, hot water in which an adequate amount of the bathing aid and/or cleaning agent is dissolved is supplied into the bathtub. This mechanism reduces the workload on the caregiver by eliminating the necessity of manually dispensing a bath agent and/or cleaning agent into the hot water held in the bathtub. Since the liquid agent is dissolved into hot water before the hot water is poured into the bathtub, the liquid agent quickly diffuses over the hot water held in the bathtub. Therefore, the liquid agent can be immediately felt by the bather from the beginning of the bathing.

To solve the above problem, the present invention provides, as the eighth invention, a bathing aid, which includes:

a wheelchair separable into a seat unit for a bather to sit down on and a bogie unit located under the seat unit;

a bathtub having an open top for receiving the seat unit with the bather sitting thereon;

a tank for storing hot water to be supplied into the bathtub, a water supply pipe connecting the tank and the bathtub;

a water temperature regulator for regulating the temperature of the hot water to be introduced into the tank;

a bypass pipe for sending the hot water to be introduced into the tank directly to the water supply pipe; and a water supply controller for supplying hot water from the tank through the water supply pipe into the bathtub in a normal mode, and for supplying the hot water whose temperature is regulated by the temperature regulator, through the bypass pipe and the water supply pipe into the bathtub in a special mode.

The bathing aid according to the eighth invention provides two modes for supplying hot water: normal mode and special mode. In normal mode, the hot water stored in the tank is supplied through the water supply pipe into the bathtub. Under some circumstances, however, the hot water stored in the tank may be slightly cooled and the bather may desire that the temperature of the hot water in the bathtub be slightly raised. Then, the special mode should be selected. In special mode, hot water whose temperature is regulated by the temperature regulator is supplied through the bypass pipe and the water supply pipe into the bathtub, instead of the water stored in the tank. By setting the objective temperature of the temperature regulator higher than the temperature of the hot water stored in the tank, it is possible to supply the bathtub with hot water whose temperature is slightly higher than that of the hot water held in the bathtub at the moment. The hot water having a higher temperature will slightly raise the overall temperature of the hot water in the bathtub, so that the bather can take a bath at an appropriate temperature.

BRIEF DESCRIPTION OF THE DRAWINGS

FIG. 5A is the front view and FIG. 5B is the side view

FIG. 22A is a general side view of the main unit, FIG. 22B is a front view without the bathtub, and FIG. 22C is an enlarged view of a part of FIG. 22B.

FIG. 23A is a side view and FIG. 23B is a front view.

DETAILED DESCRIPTION OF A PREFERRED EMBODIMENT

Referring to the attached drawings, an embodiment of the bathing aid according to the present invention is described. The bathing aid in this embodiment may be referred to as the "apparatus" or the "present apparatus" hereinafter.

Figure 1:
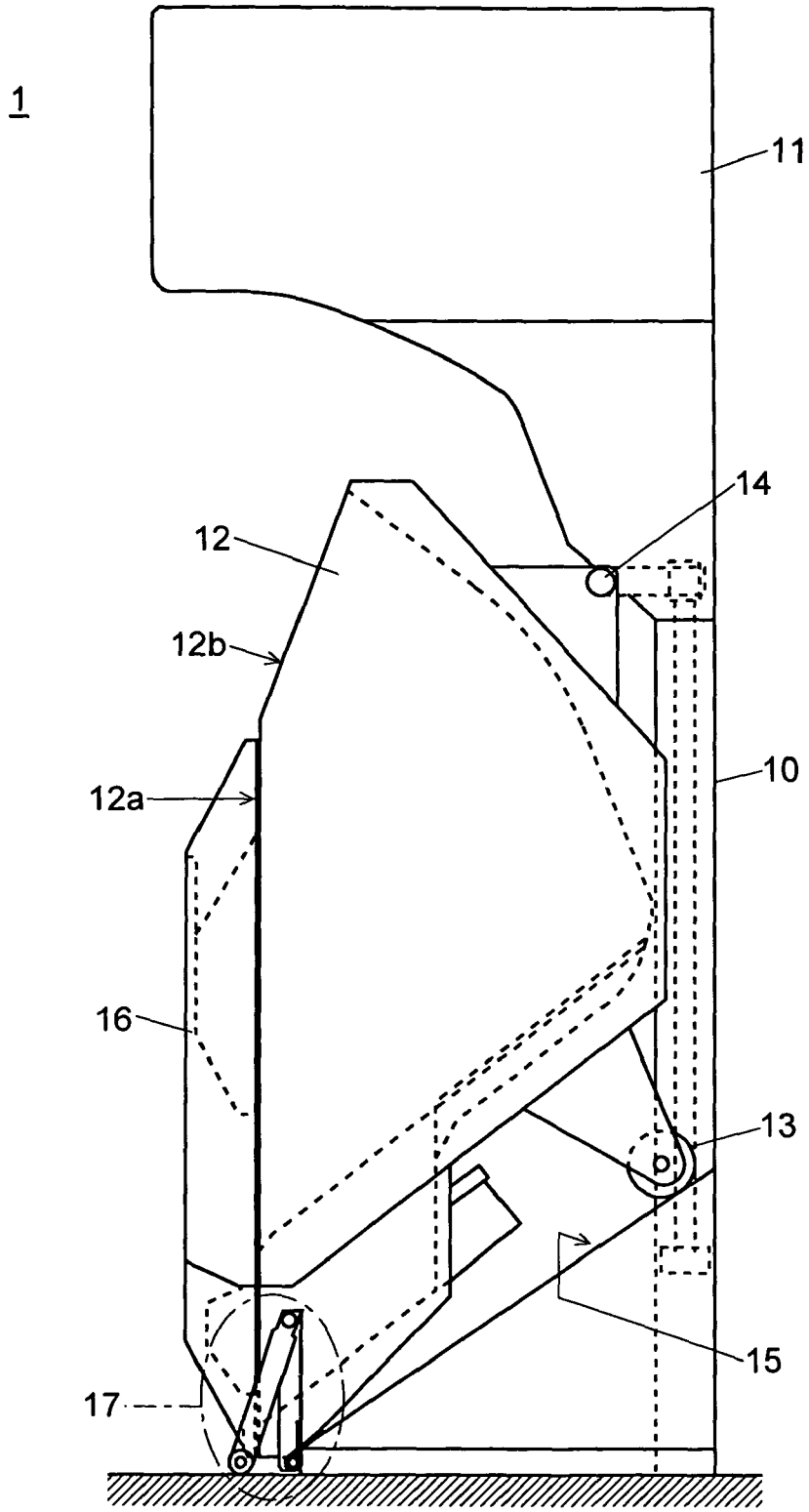
FIG. 1 is a side view schematically showing the general structure of the bathing aid of an embodiment of the present invention ("storage state").
Figure 2:
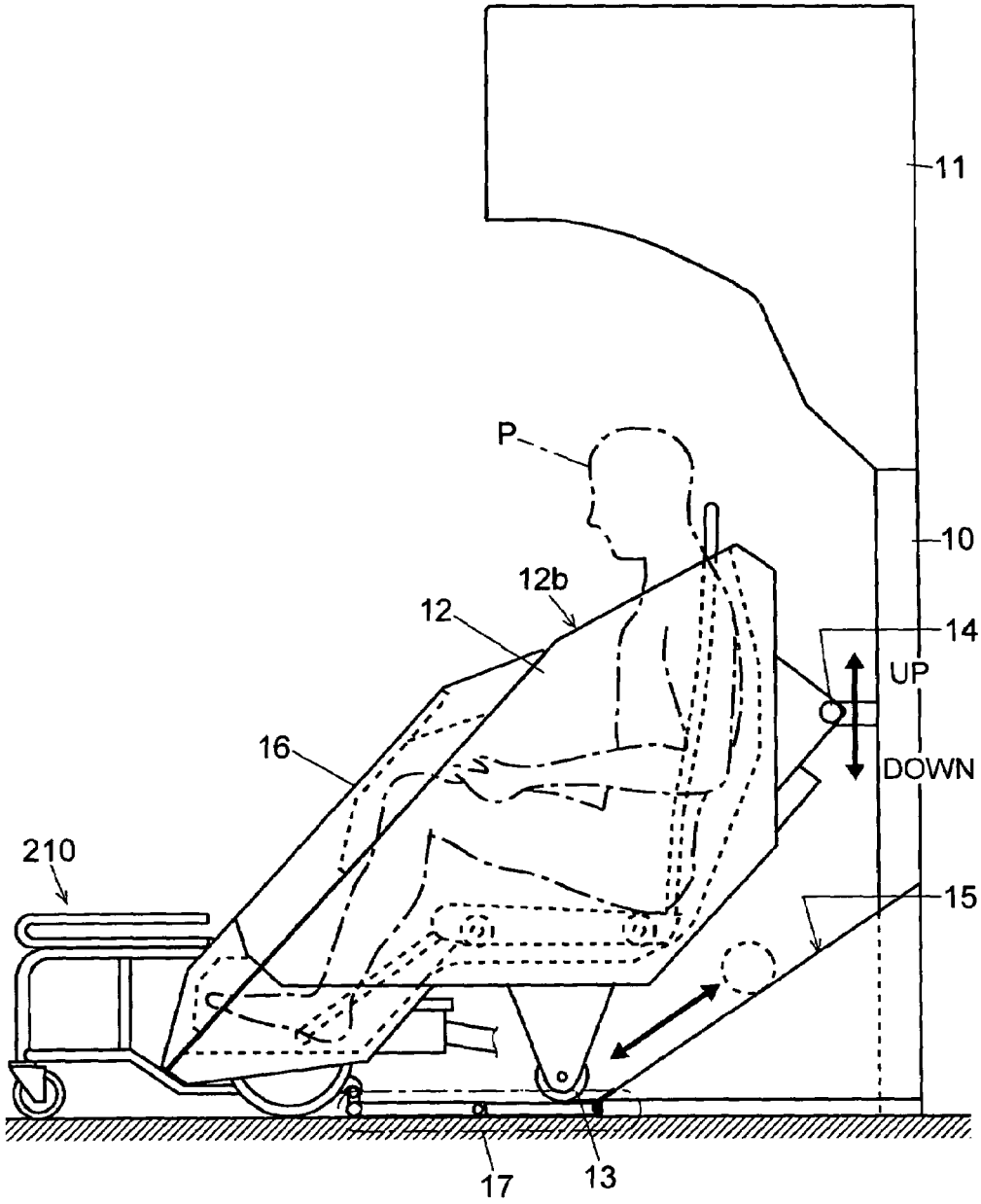
FIG. 2 is a side view schematically showing the general structure of the bathing aid of the embodiment ("setting state").
Figure 3:
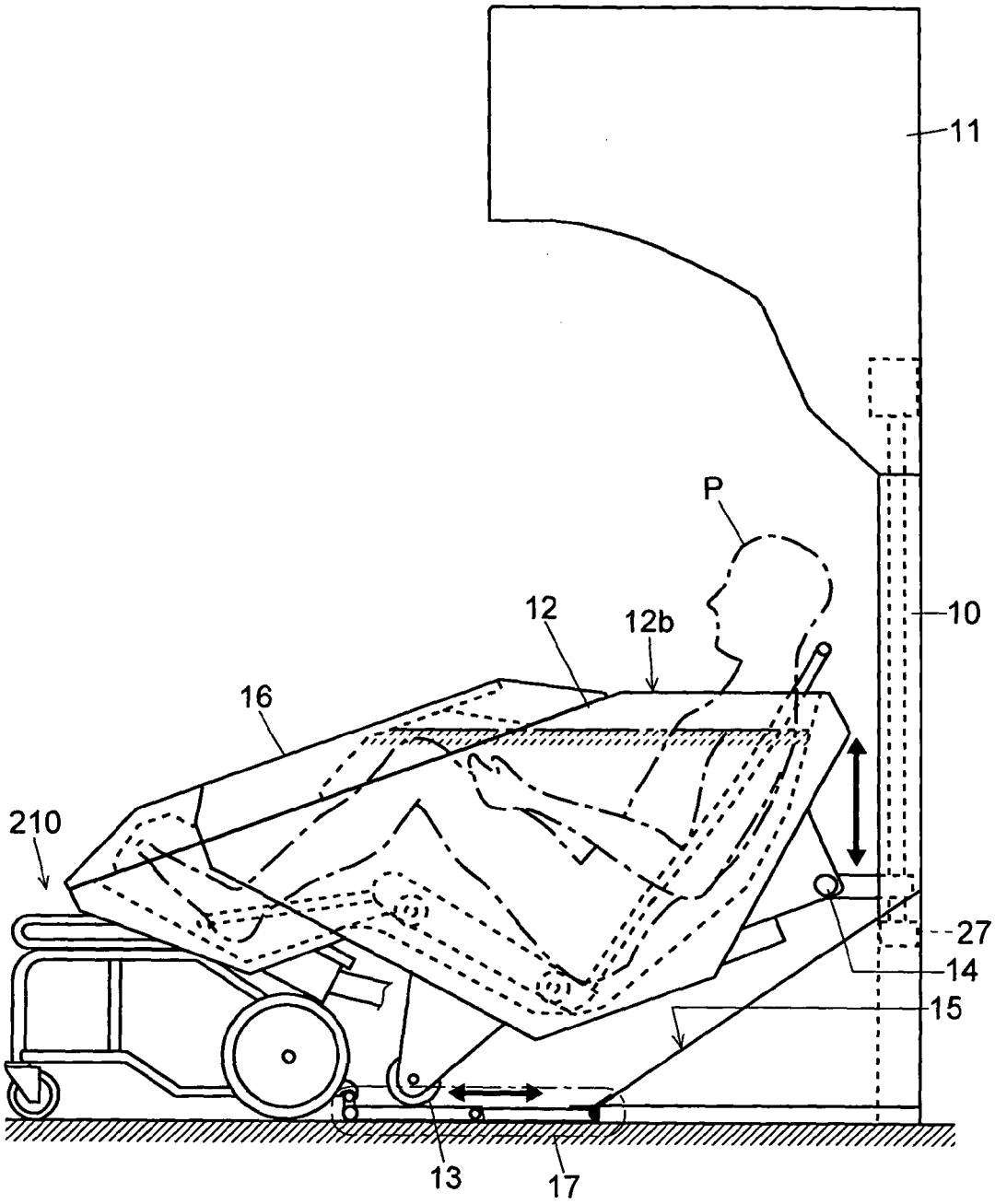
FIG. 3 is a side view schematically showing the general structure of the bathing aid of the embodiment ("normal bathing state").
Figure 4:
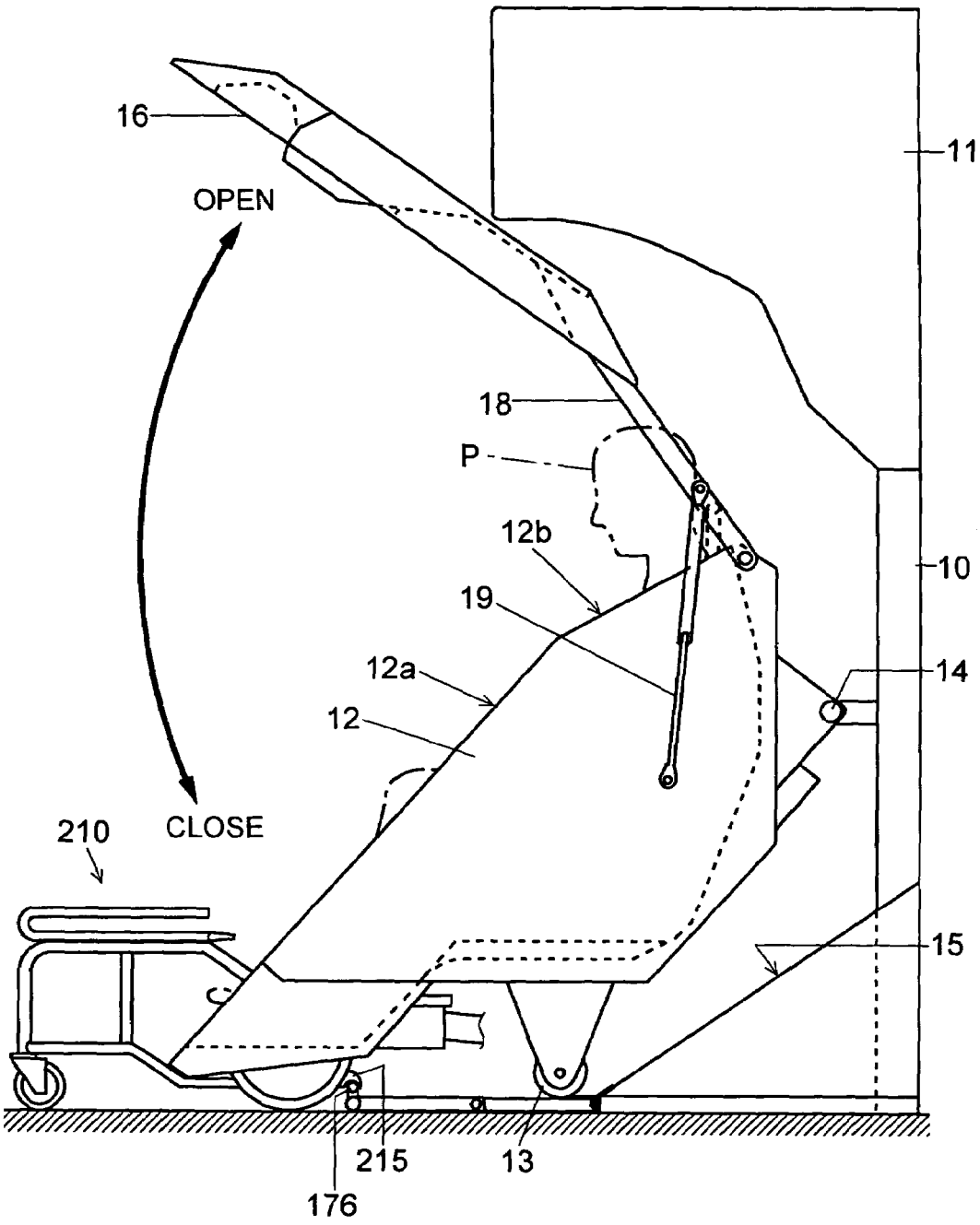
FIG. 4 is a side view of the bathing aid shown in FIG. 2 with the cover of the bathtub opened.
Figure 5B:
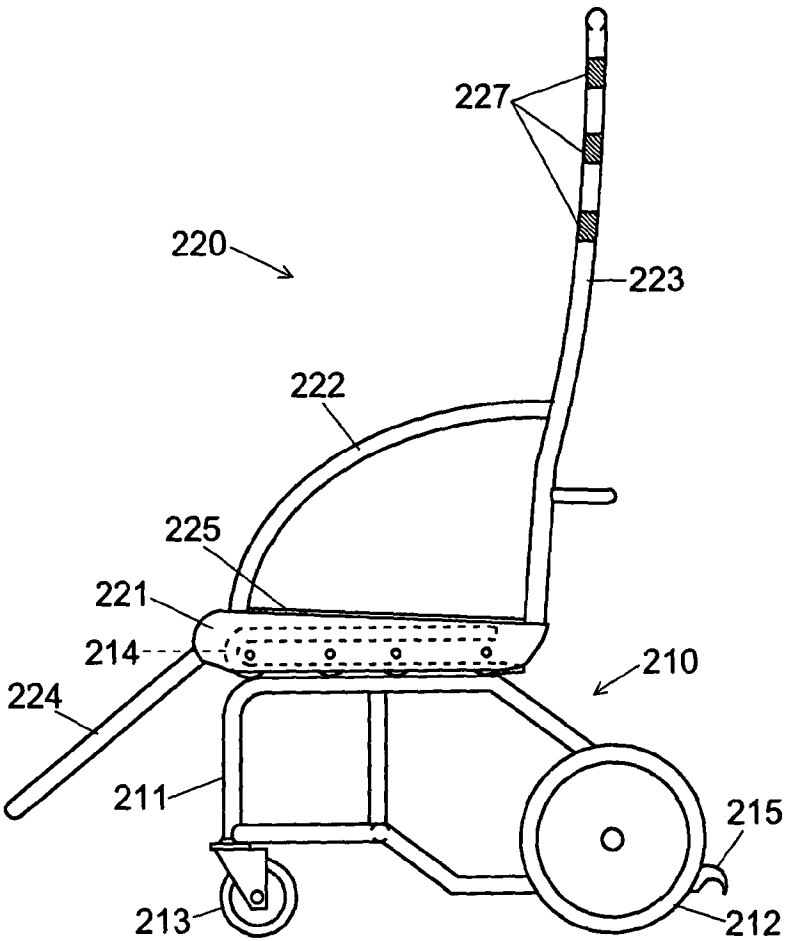
FIGS. 5A and 5B show the wheelchair to be exclusively used in the bathing aid of the embodiment, where
Figure 5A:
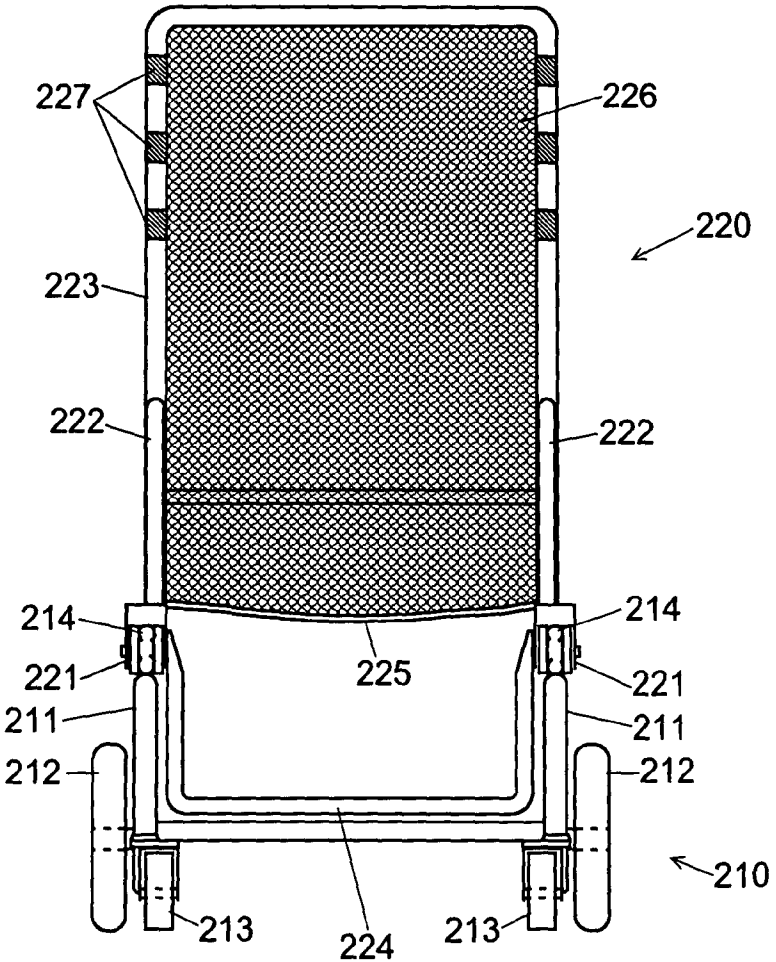

FIGS. 1–4 are side views schematically showing the general structure of the present apparatus. FIG. 1 shows the state where the bathtub is stored. FIG. 2 shows the state where the bather sitting in a wheelchair is transferred into the bathtub or transferred from the bathtub back to the wheelchair (this state is referred to as the "setting state" hereinafter). FIG. 3 shows the state where the bathtub is further tilted from the setting state to a state for bathing (this state is referred to as the "normal bathing state" hereinafter). FIG. 4 shows the state where the cover of the bathtub in FIG. 2 is opened. FIGS. 5A and 5B show the wheelchair to be exclusively used in the apparatus, where FIG. 5A is the front view and FIG. 5B is the side view.

The present apparatus is mainly composed of a main unit 1 with a bathtub 12 into which the bather (i.e. a cared person) in a sitting position is transferred, and a dedicated wheelchair 2 for transferring the bather into or out of the bathtub 12.

The main unit 1 has a pillar 10 located in the rear part and a tank 11 having the capacity of about 200 L mounted on the pillar 10. The height of the top of the tank 11, i.e. the height of the present apparatus, is lower than the heights of the ceilings of ordinary houses. In Japan, for example, the height of the ceilings of most houses is about 2400 mm, so that the height of the present apparatus is set at about 2300 mm. This design allows the apparatus to be used for home nursing care. A shallow bathtub 12 having a front wall and a rear wall, both being sloped down toward the center of the bottom, is located under the tank 11. The bathtub 12 is supported by right and left bathtub wheels or rollers 13 located closer to the front than the lowest point of the bottom, and a supportive shaft 14 sticking out from the rear wall. The supportive shaft 14 is moved up and down by the action of a motor, pulling up or pushing down the rear end of the bathtub 12. A guide slope 15 tilted upward toward the back is located beneath the pillar 10. With the vertical motion of the supportive shaft 14 pulling up or pushing down the rear end of the bathtub 12, the bathtub rollers 13 go up and down along the guide slope 15.

The bathtub 12 has an open top 12*a* on one side that is directed upward in the normal bathing state, as shown in FIG. 3. The open top 12*a* can be closed with a cover 16 except for an opening 12*b* in the rear part, through which the bather can stick the their head through. As shown in FIG. 4, the cover 16 is fixed to the arms 18, each arm having one end hinged via a shaft to the rear end of each sidewall of the bathtub 12. Each arm 18 is modestly urged upward by a gas spring 19. When the cover 16 is pressed onto the open top 12*a* of the bathtub 12 as shown in FIG. 2, a lock mechanism (not shown) maintains the cover 16 locked. When the user manually unlocks the cover 16 and slightly pushes it up, the cover 16 slowly opens due to the action of the gas springs 19, and finally reaches the fully opened position, as shown in FIG. 4. In the state of FIG. 4, the open top 12*a* of the bathtub 12 is tilted frontward, and the bather P can be transferred into or out of the bathtub 12, as described later.

It is technically possible hinge the cover 16 to the main unit 1 so that it opens sideward. This structure, however, is not recommendable because, if the caregiver stands on the side opposite to the cover 16, the caregiver must lean over the bathtub 12 to reach for the cover 16 and close it, which may be difficult for those who are relatively short. Furthermore, if the cover 16 is constructed to open sideward, the apparatus occupies a larger space in width direction when the cover 16 is opened. This is disadvantageous with respect to installation space, especially when the user uses plural apparatuses arranged side by side. The upward-opening cover 16, on the other hand, not only allows the caregiver to stand on whichever side of the bathtub 12 and open or close the cover 16 without difficulty, but also reduces the maximal width of the main unit 1.

Figure 6:
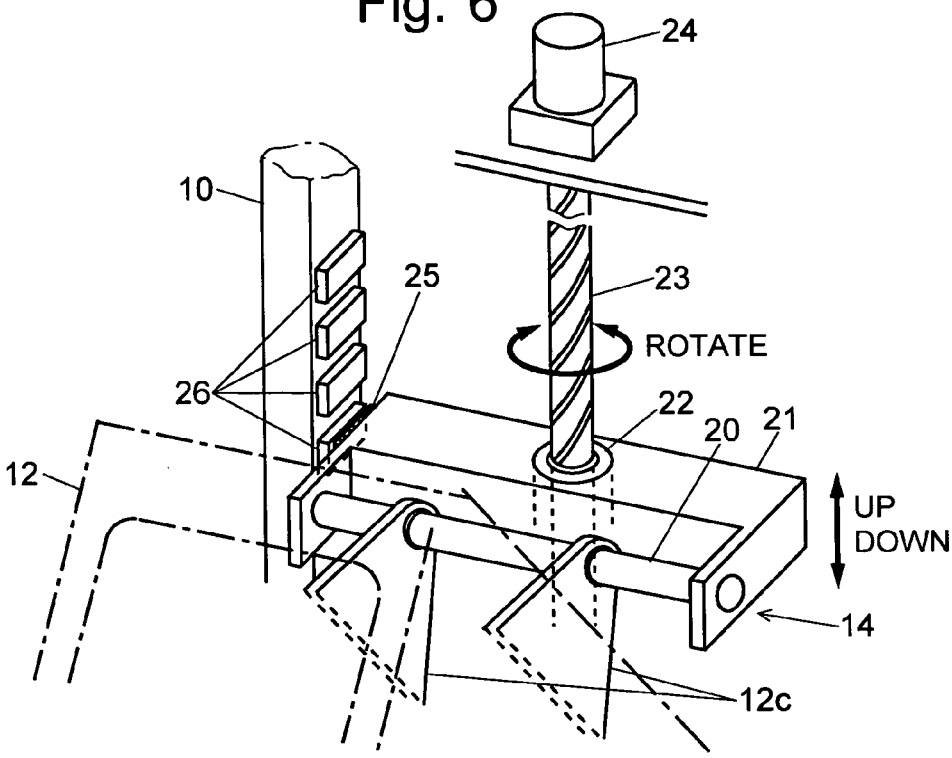
FIG. 6 is a perspective view of a part of the bathing aid of the embodiment including the supportive shaft for tilting the bathtub.
Figure 7:
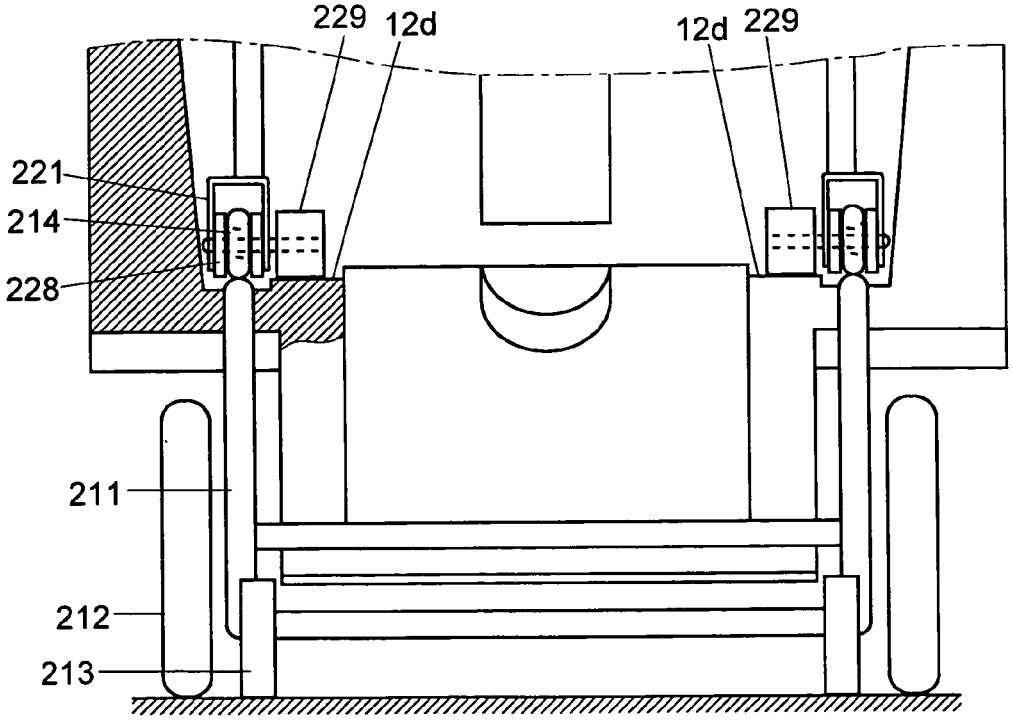
FIG. 7 is a front view of a part of the bathing aid of the present embodiment in the setting state.

FIG. 6 is a perspective view of the main part of the supportive shaft 14 for tilting the bathtub 12 of the main unit 1. The bathtub 12 has a pair of supporting plates 12*c* sticking out from the rear side. Each plate 12*c* has a hole, through which a horizontal shaft 20 is passed. Both ends of the shaft 20 are fixed to a movable unit 21, which has a ball screw nut 22 engaged with the grooves formed on the vertical screw shaft 23. When the screw shaft 23 is rotated by the motor 24, the balls in the ball screw nut 22 spirally roll along the grooves on the screw shaft 23. This makes the movable unit 21 move up or down along the screw shaft 23. This motion is transmitted via the horizontal shaft 20 and the plates 12*c* to the rear end of the bathtub 12. Thus, the rear end of the bathtub 12 is pulled up or pushed down.

In FIG. 6, a magnet 25 is attached to one side of the movable unit 21, and four reed switches 26 are vertically attached to the pillar 10 located close to the magnet 25. When the movable unit 21 moves up and down, the reed switches 26 turn on according to the position of the movable unit 21. This mechanism will be detailed later.

As shown in FIG. 5, the wheelchair 2 includes a bogie unit 210 having a front wheel 213 with a small diameter and a rear wheels 212 with a large diameter on each side, and a seat unit 220 for a bather to sit down on. The seat unit 220 can slide backward on the bogie unit 210. The seat unit 220 includes right and left bases 221 each having plural wheels inside, a back frame 223 fixed to the rear ends of the bases 221, and armrests 222 bridged between the back frame 223 and the bases 221. The bases 221 have a footrest 224 for the bather to rest the feet on. A mesh seat 225 is stretched between the two bases 221 with an appropriate tension, and a mesh backing 226 is similarly stretched on the back frame 223. The use of the mesh material for the seat 225 and the backing 226 allows water and air to freely pass through. Thus, the water and air can easily touch the parts of the body surface of the bather that are in contact with the seat 225 and the backing 226. The back frame 223 has three level marks to be used as a reference for the caregiver to determine the amount of hot water to supply.

Referring to FIGS. 7–11B in addition to FIG. 5, the mechanism for sliding the seat unit 220 of the wheelchair 2 and the steps of transferring the bather into or out of the bathtub 12 are described.

On the top of each of the right and left supporting bars 211 of the bogie unit 210, a U-shaped guide rail 214 is fixed with its open end directed backward. In the base 221 of the seat unit 220, four bogie-side rollers 228 are arranged in the back-to-front direction at appropriate intervals. Each roller 228 consists of a pair of disks 228*a* with a core 228*b* clamped in between. The disks 228*a* clamp the guide rail 214 from both sides, and the core 228*b* comes in contact with the guide rail 214 on its upper and lower sides. In addition, there are bathtub-side rollers 229 located on the inside of three of the four bogie-side rollers 228. The bogie-side rollers 228 rolling back and forth on the guide rails 214 enable the seat unit 220 to slide back and forth on the bogie unit 210, where the bathtub-side rollers 229 are not working. The bathtub 12 has bathtub-side rails 12*d* formed on its inner sidewalls. In the setting state, the bathtub-side rails 12*d* come to an almost horizontal position. When the seat unit 220 is in the bathtub 12, the bathtub-side rollers 229 roll on the bathtub-side rails 12*d*, producing the sliding motion of the seat unit 220. Inside the bathtub 12, the bogie-side rollers 228 do not work because they are in the air.

Thus, the bogie-side rollers 228 are used only for sliding the seat unit 220 on the bogie unit 210, and the bathtub-side rollers 229 are used only for sliding the seat unit 220 in the bathtub 12. Therefore, it is possible to make each roller of a specific material that is suitable for the material used in the rail corresponding to the roller. A suitable selection of the materials reduces the friction noise arising when the rollers run on the rails. Furthermore, the reduction in the friction between the rollers and the rails provides a high degree of reliability.

Figure 8:
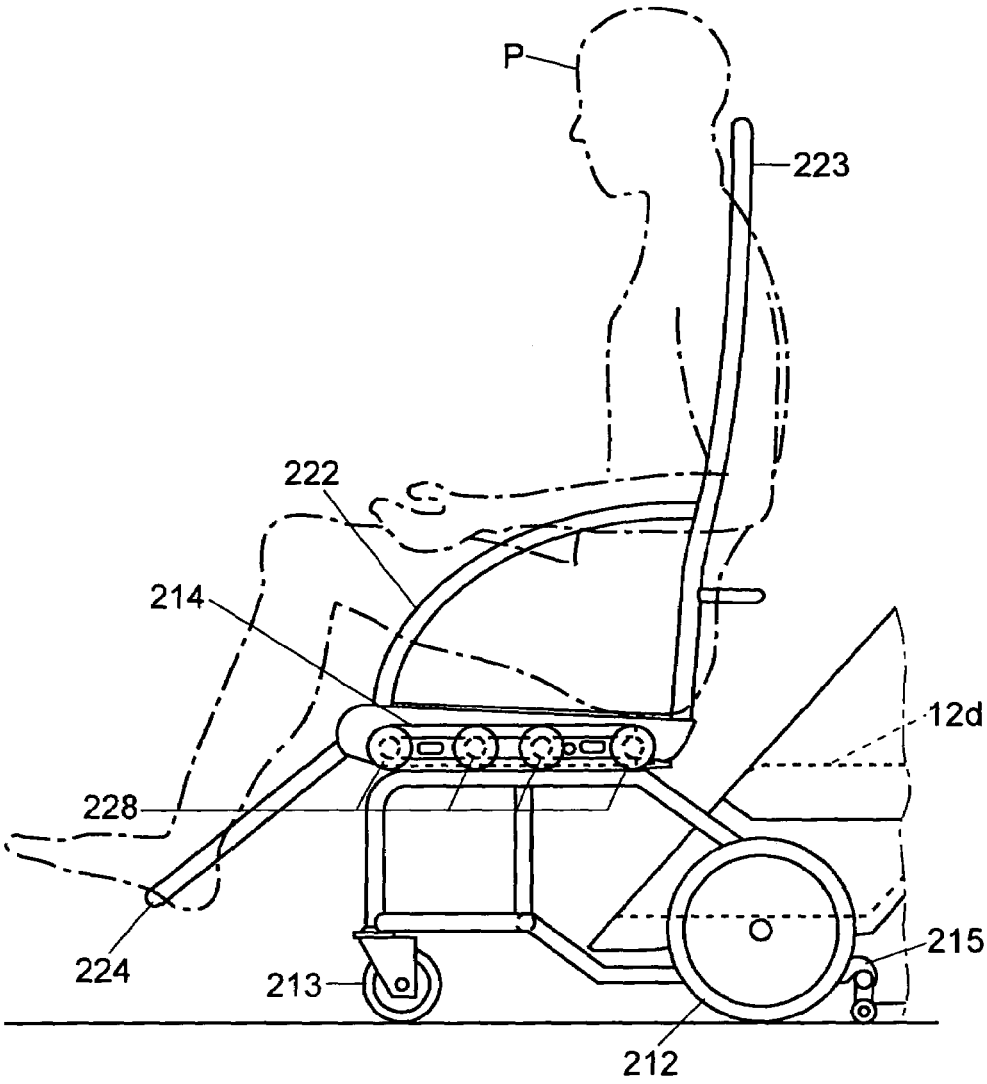
FIG. 8 is a side view of a part of the bathing aid of the present embodiment in the setting state.

When the cover 16 is opened as shown in FIG. 4, the bather P sitting in the seat unit 220 of the wheelchair 2, as in FIG. 8, can be transferred into the bathtub 12 by the following steps.

As shown in FIG. 8, the wheelchair 2 is moved back toward the bathtub 12. Then, the bogie unit 210 is temporarily fastened to the main unit 1 by engaging the predetermined part or bogie-side books 215, located at the rear end of the bogie unit 210 of the wheelchair 2, with the stopper 176 of the main unit 1. From this state, the caregiver pushes the seat unit 220, or the bather P, into the bathtub 12. Then, the bogie-side rollers 228 roll on the guide rails 214, making the seat unit 220 sliding backward with the bather P sitting thereon.

Figure 10A:
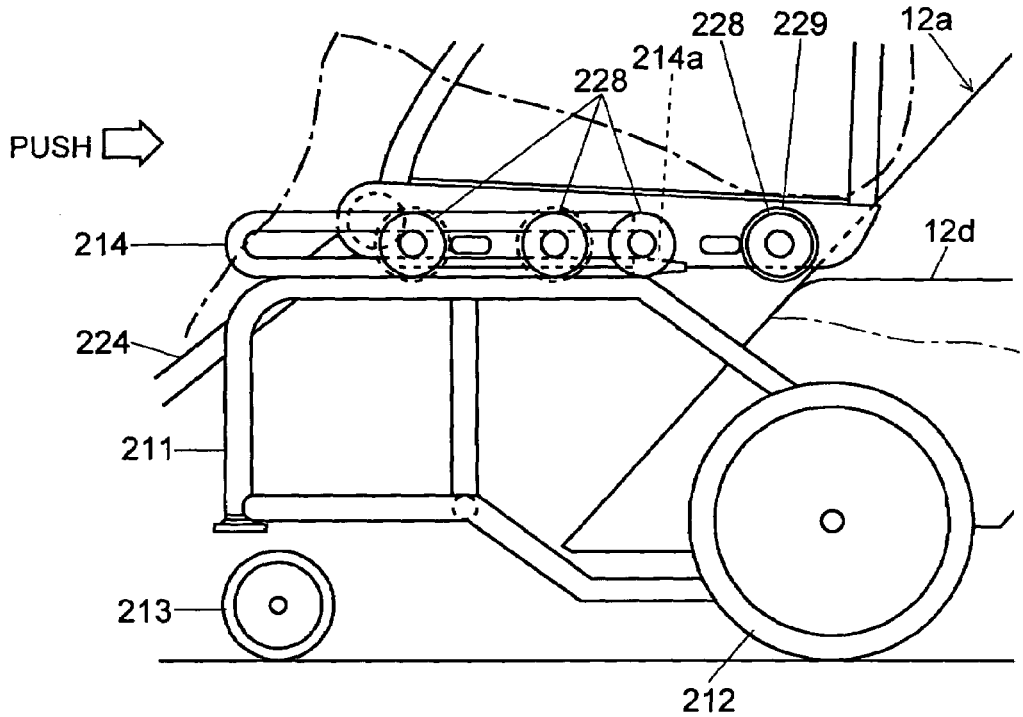
FIGS. 10A and 10B are side views of the wheelchair with a bather being transferred into the bathtub.
Figure 10B:
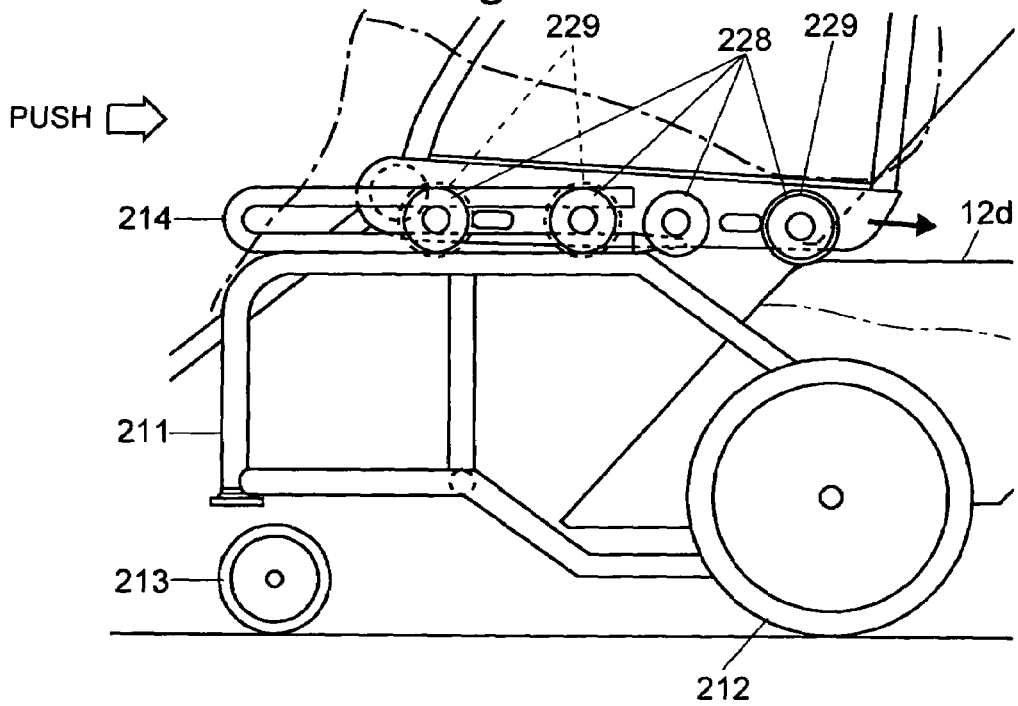

In the course of the sliding motion, even when, as shown in FIG. 10A, the rearmost bogie-side roller 228 comes off the guide rail 214, the seat unit 220 maintains itself almost horizontal because the other three bogie-side rollers 228 are still on the guide rail 214. Before the second rearmost bogie-side roller 228 comes off the guide rail 214, the rearmost bathtub-side roller 229 comes onto the bathtub-side rail 12*d*, as shown in FIG. 10B. After that, while the seat unit 220 is further pushed backward, the rear and front sides of the seat unit 220 is supported by the bathtub-side roller 229 and the bogie-side roller 228, respectively (see FIG. 11A).

Figure 11A:
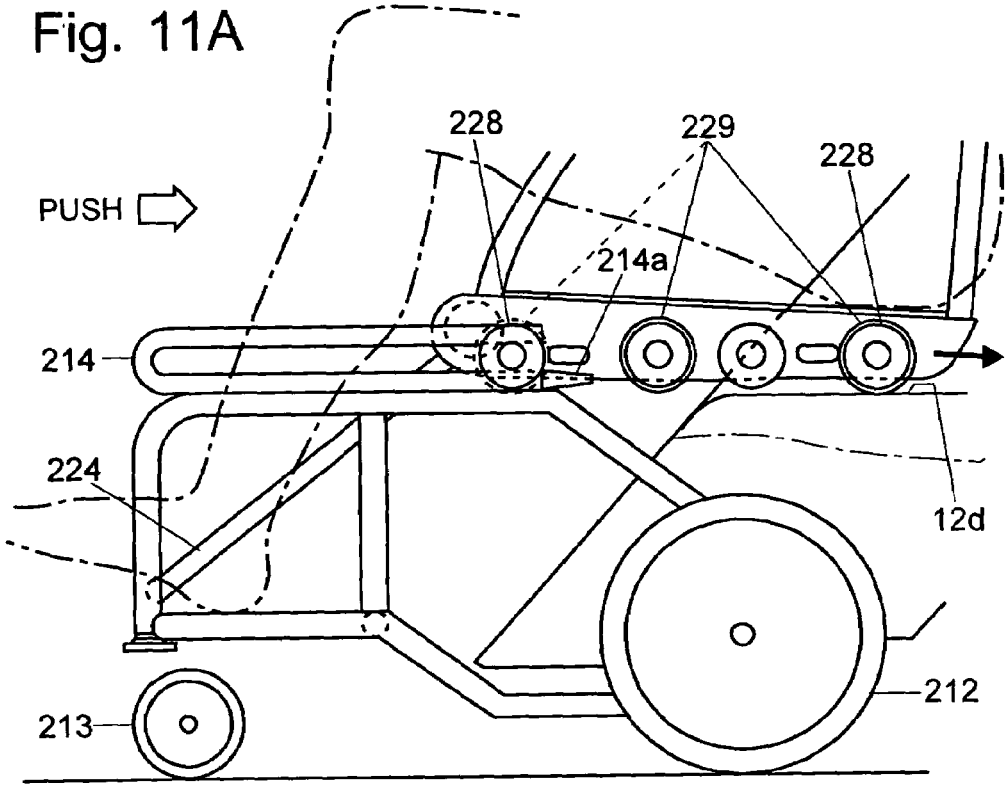
FIGS. 11A and 11B are side views of a bather being transferred from the wheelchair into the bathtub.
Figure 11B:
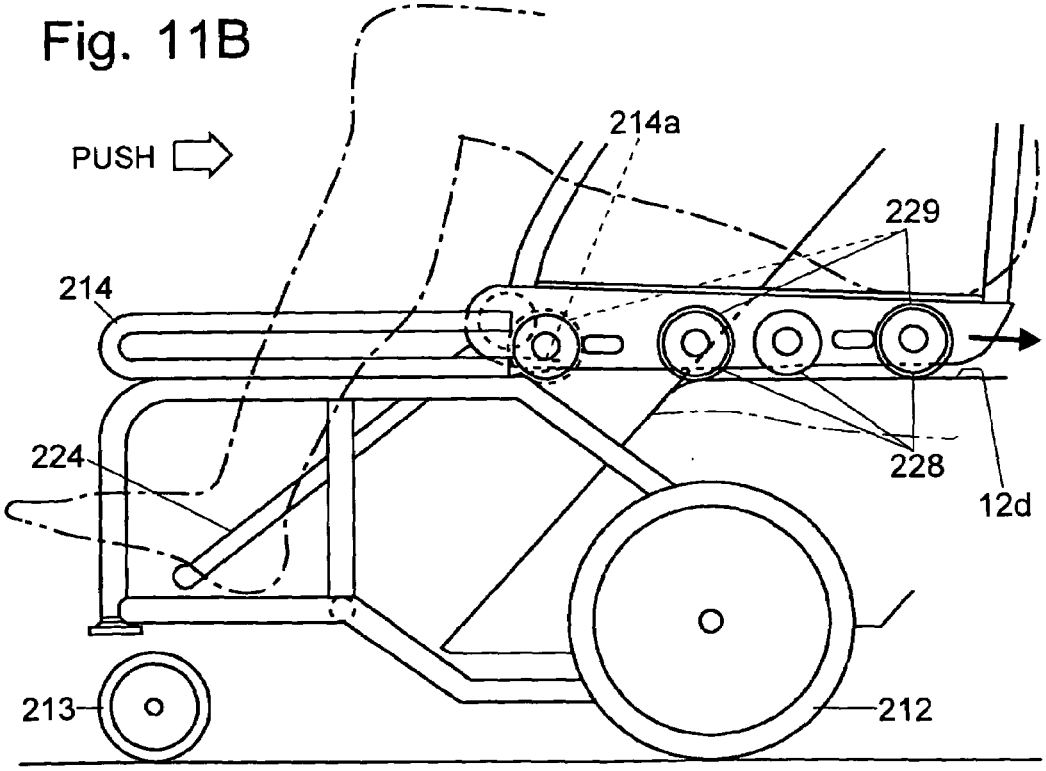

As shown in FIG. 11B, the second-from-the-front bathtub-side roller 229 comes onto the bathtub-side rail 12*d* before the foremost bogie-side roller 228 comes off the guide rail 214. After that, the bathtub-side rollers 229 roll on the bathtub-side rail 12*d*, making the seat unit 220 slide backward until the bather P is completely set in the bathtub 12. When the seat unit 220 is completely transferred into the bathtub 12, only the bogie unit 210 is left in front of the bathtub 12.

After bathing is completed, the seat unit 220 can be transferred from the bathtub 12 back to the bogie unit 210 of the wheelchair 2 by following the aforementioned steps in reverse.

Figure 9A:
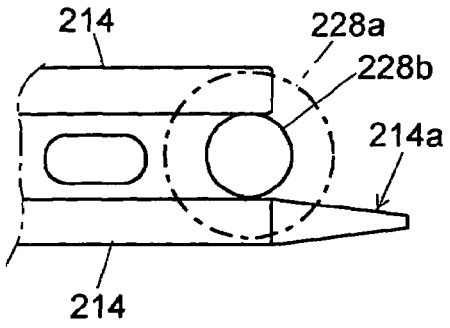
FIGS. 9A and 9B is an enlarged view of a part of the wheelchair shown in FIG. 5.
Figure 9B:
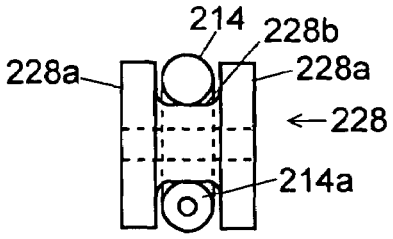

As shown in FIG. 9, the rear end 214*a* of the lower rail element of the guide rail 214 has an inclined profile whose upper side descends toward the tip. This profile provides a smooth landing of the bogie-side roller 228 onto the tip of the guide rail 214 when the seat unit 220 is transferred from the bathtub 12 to the bogie unit 210. Therefore, the bather sitting in the seat unit 220 will experience only a slight shock.

Figure 12A:
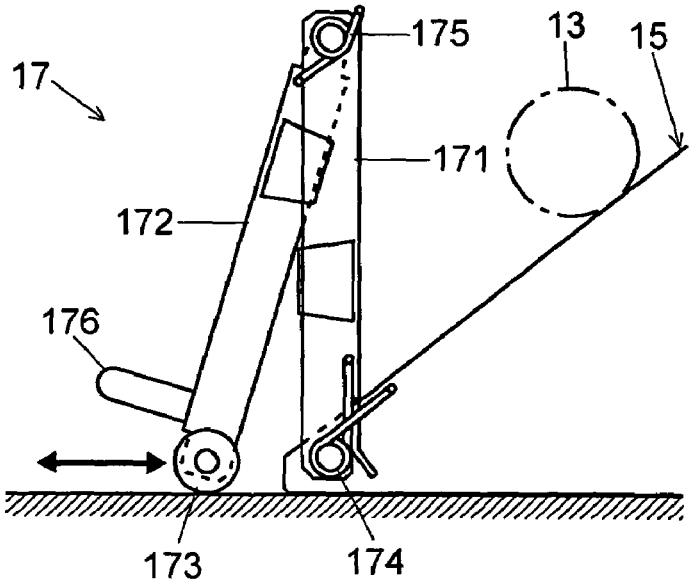
FIGS. 12A and 12B are side views of the expansion mechanism or expansible bogie-fastening element, of the bathing aid of the embodiment.
Figure 12B:
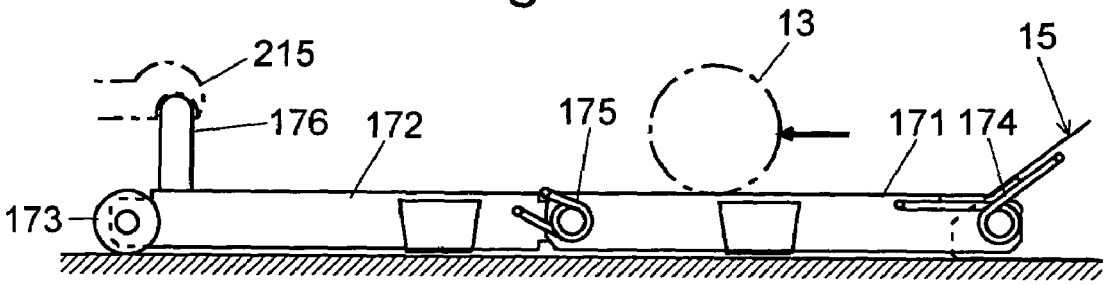

As described earlier, the main unit 1 is provided with the stopper 176 for fastening the bogie unit 210 of the wheelchair 2. When the bathtub 12 is stored as shown in FIG. 1, the stopper will be obstructive and may cause someone to stumble if it is left sticking frontward. Therefore, the present apparatus is provided with an expansible bogie-fastening element 17 for moving the stopper 176 back and forth along with the tilting motion of the bathtub 12. FIGS. 12A and 12B are side views showing the construction of the expansible bogie-fastening element 17. On each side of the guide slope 15, an end of the first member 171 is connected to the shaft. The first member 171 has a shaft at the other end, and an end of the second member 172 is connected to the shaft. The second member 172 has a roller 173 at the other end. The roller 173 is placed on the floor and rolls on it.

The connection part between the guide slope 15 and the first member 171 has a torsion coil spring 174, and the connection part between the first member 171 and the second member 172 has another torsion coil spring 175. When no external force is exerted, the urging force of the torsion coil springs 174 and 175 makes the first member 171 and the second member 172 stand up with the roller 173 attracted to the guide slope 15 (see FIG. 12A). With the two members thus folded, the stopper 176 will never be obstructive. When the bathtub 12 is moved from the stored state to the setting state, the bathtub roller 13 comes down the guide slope 15, as described above. With the weight of the bathtub 12 exerted thereon, the bathtub roller 13 pushes down the first member 171, which in turn pushes down the second member 172 with the roller 173 rolling frontward. Thus, the two members 171 and 172 expand themselves, and finally become flattened on the floor with the stopper 176 standing upright at the front end of the second member 172, as shown in FIG. 12B.

Figure 13A:
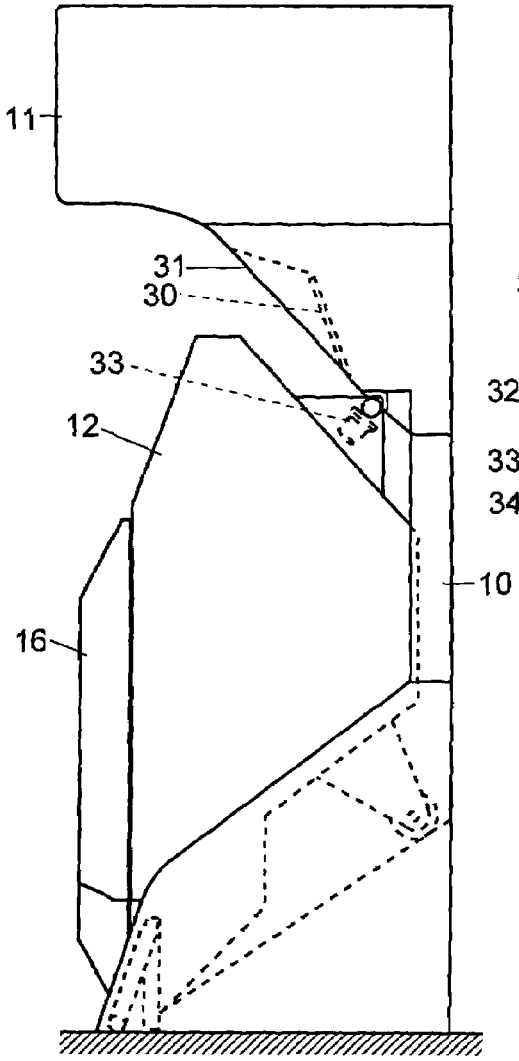
FIG. 13A is a side view.
Figure 13B:
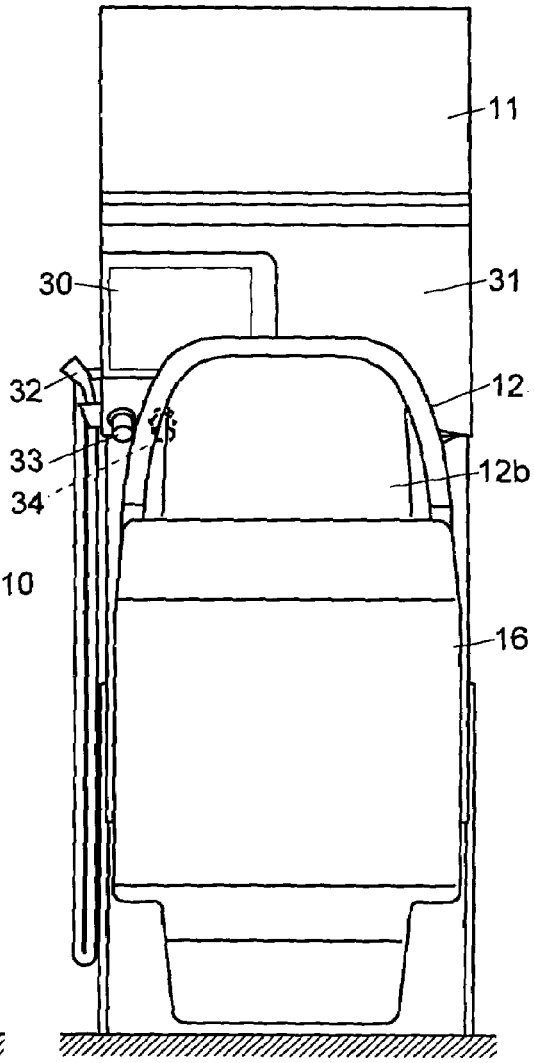
FIG. 13B is a front view of the main unit of the bathing aid of the embodiment with the bathtub in the stored state.

FIG. 13A is a side view, and FIG. 13B is a front view of the main unit 1 in the state where the bathtub 12 is stored. As shown in FIG. 13B, the main unit 1 has an operation panel 30 on the left side of the slope 31 under the tank 11, which panel is used to operate the main unit 1.

Figure 14:
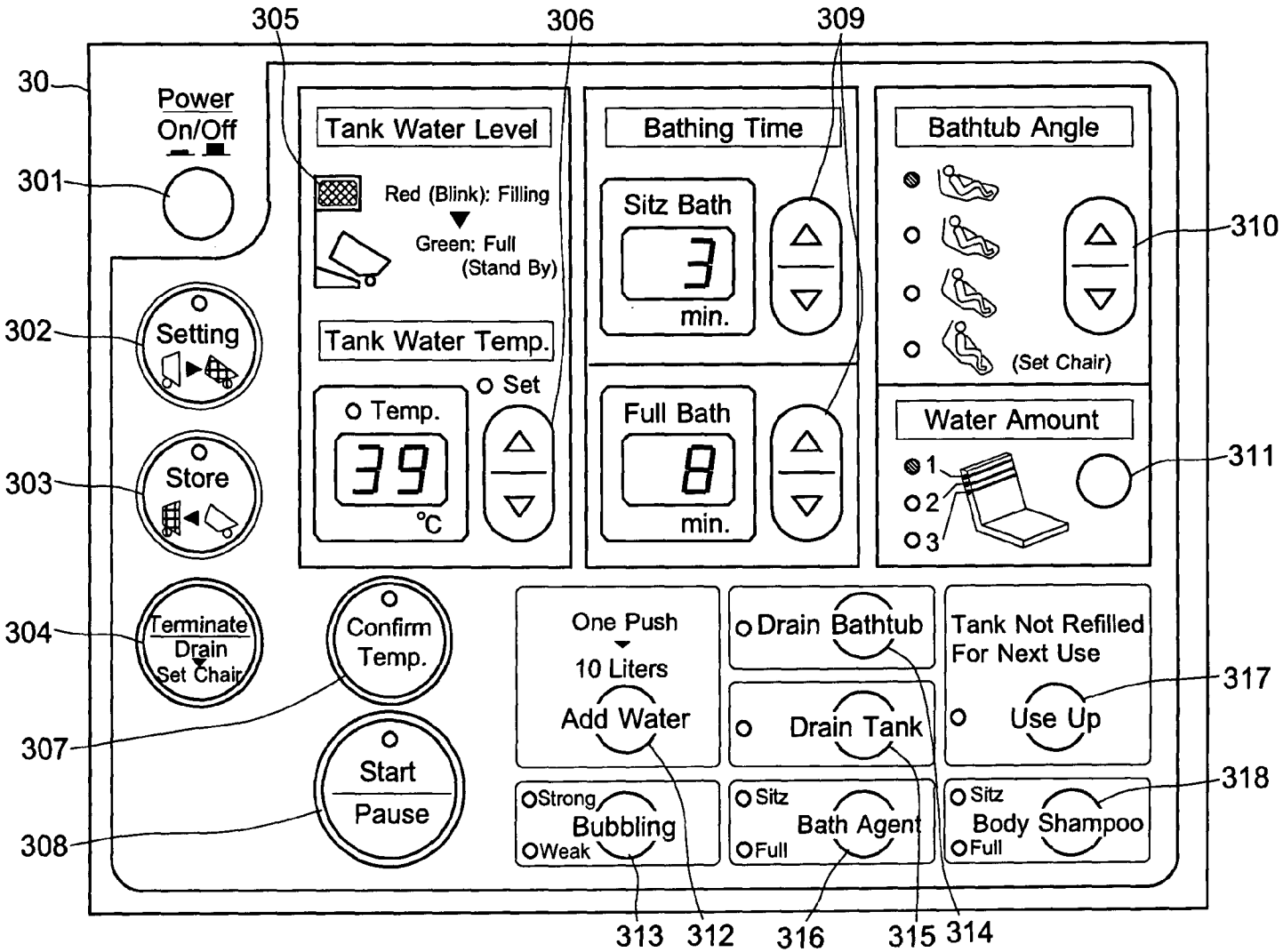
FIG. 14 is an enlarged view of the operation panel of the bathing aid of the embodiment.

FIG. 14 is an enlarged view of the operation panel 30. The operation panel 30 has the following keys and indicators: power switch 301; setting key 302; storage key 303; termination key 304; tank water amount check display 305; tank water temperature setting key 306 having a temperature indicator; temperature confirmation key 307; start key 308; bathing time setting key 309 having a time indicator; bathtub angle setting key 310 having an angle indicator; water amount setting key 311 having an amount selection indicator for bathtub water; add water key 312; bubbling key 313; bathtub drainage key 314; tank drainage key 315; bath agent injection key 316; use-up key 317; body shampoo injection key 318.

As shown in FIG. 13B, when the bathtub 12 is stored, the operation panel 30 is partially hidden behind the bathtub 12. It is not impossible to make operations, but it is also not easy because some indicators are hidden. Therefore, in the present apparatus, the keys that must be used when the bathtub 12 is in the stored state are arranged on the left side of the panel 30. These keys include the power switch 301, setting key 302, storage key 303, termination key 304; tank water amount check display 305 and tank water temperature setting key 306. This arrangement provides sufficient accessibility to the keys. On the left side viewed from the front, the main unit 1 has a showerhead 32 for supplying a shower of hot water. The main unit 1 also has a shower valve 33 and a shower temperature adjustment knob 34, both located under the operation panel 30.

The steps of supplying hot water into the bathtub and draining the bathtub by the present apparatus are described.

Figure 15:
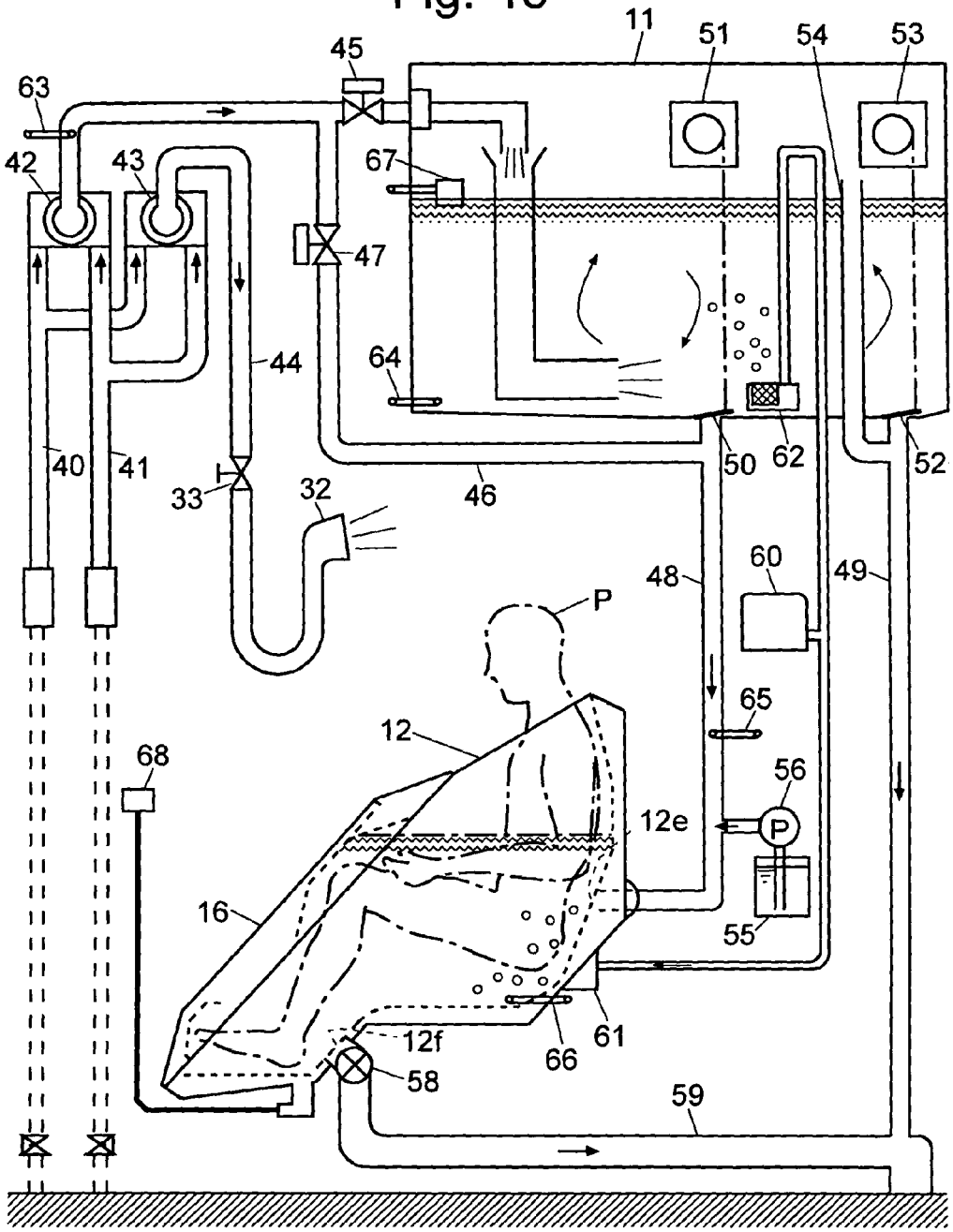
FIG. 15 is a diagram showing the piping for supplying and draining water in the present bathing aid of the embodiment.
Figure 16A:
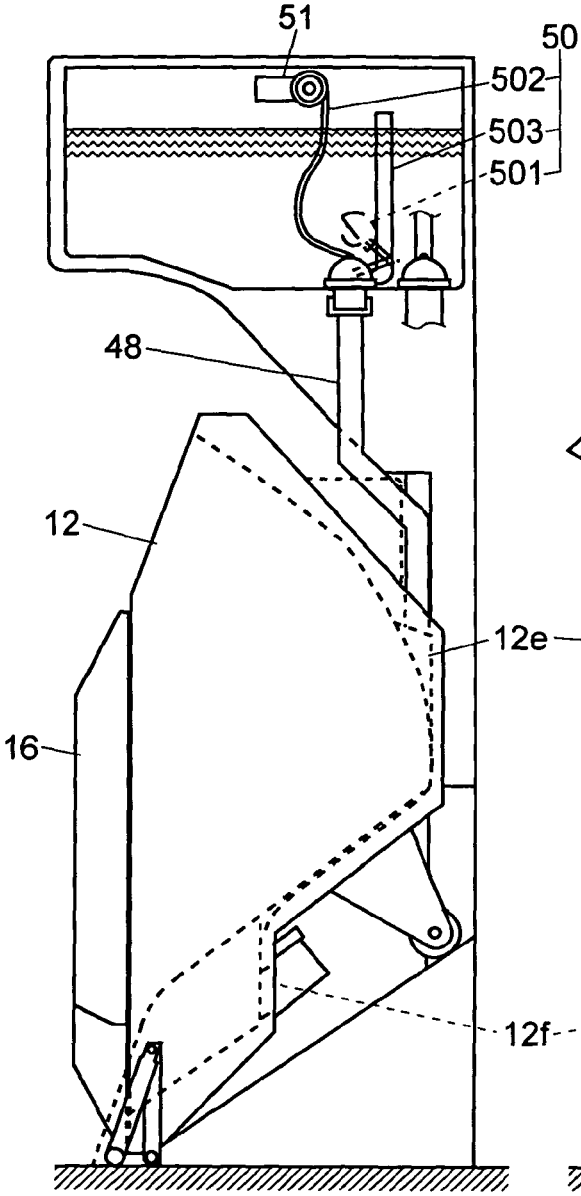
FIGS. 16A and 16B are structural drawings mainly showing the hot water supply line of the bathing aid of the embodiment.
Figure 16B:
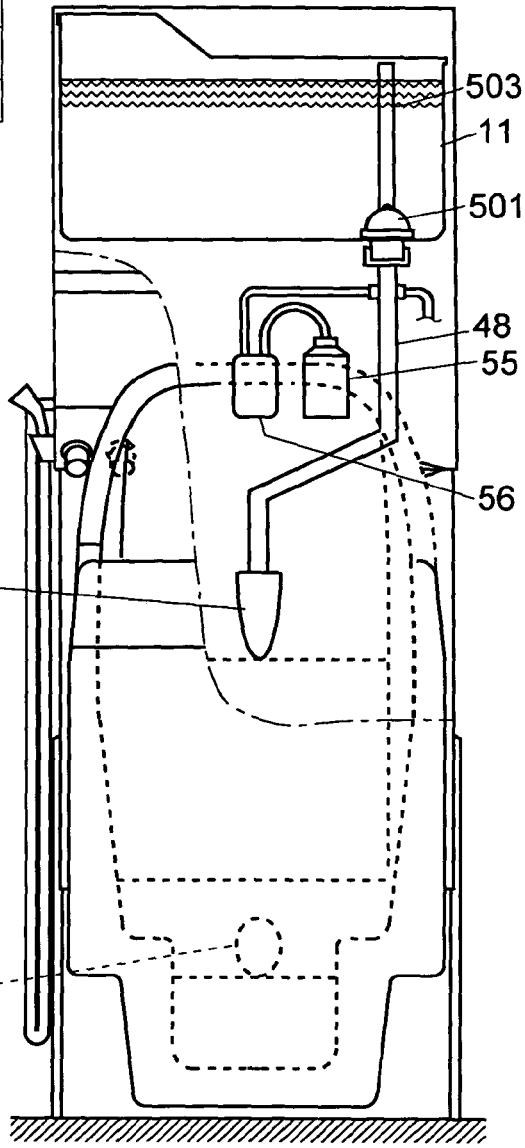
Figure 17:
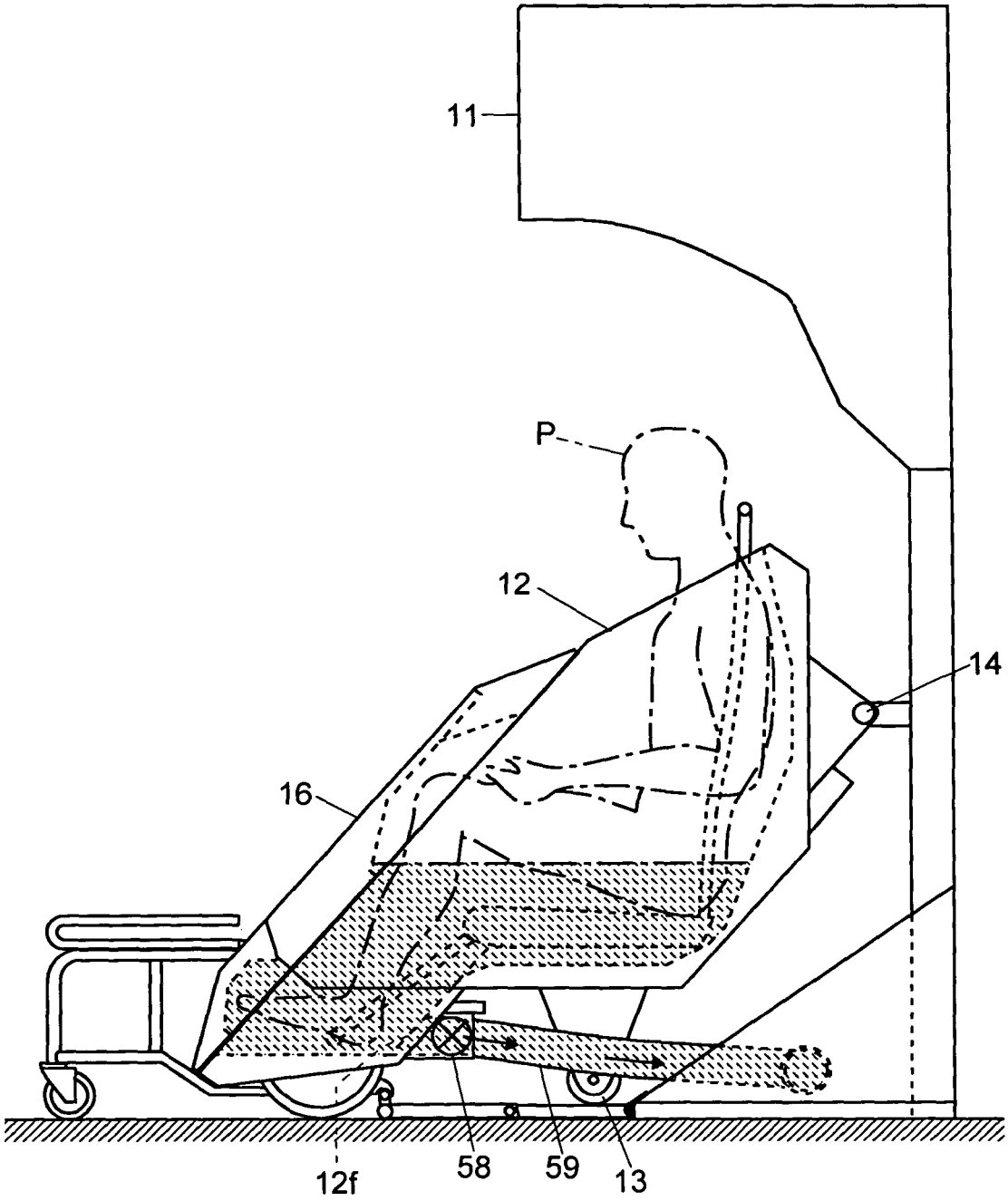
FIG. 17 is a side view of a drainage line of the bathing aid of the embodiment.
Figure 18:
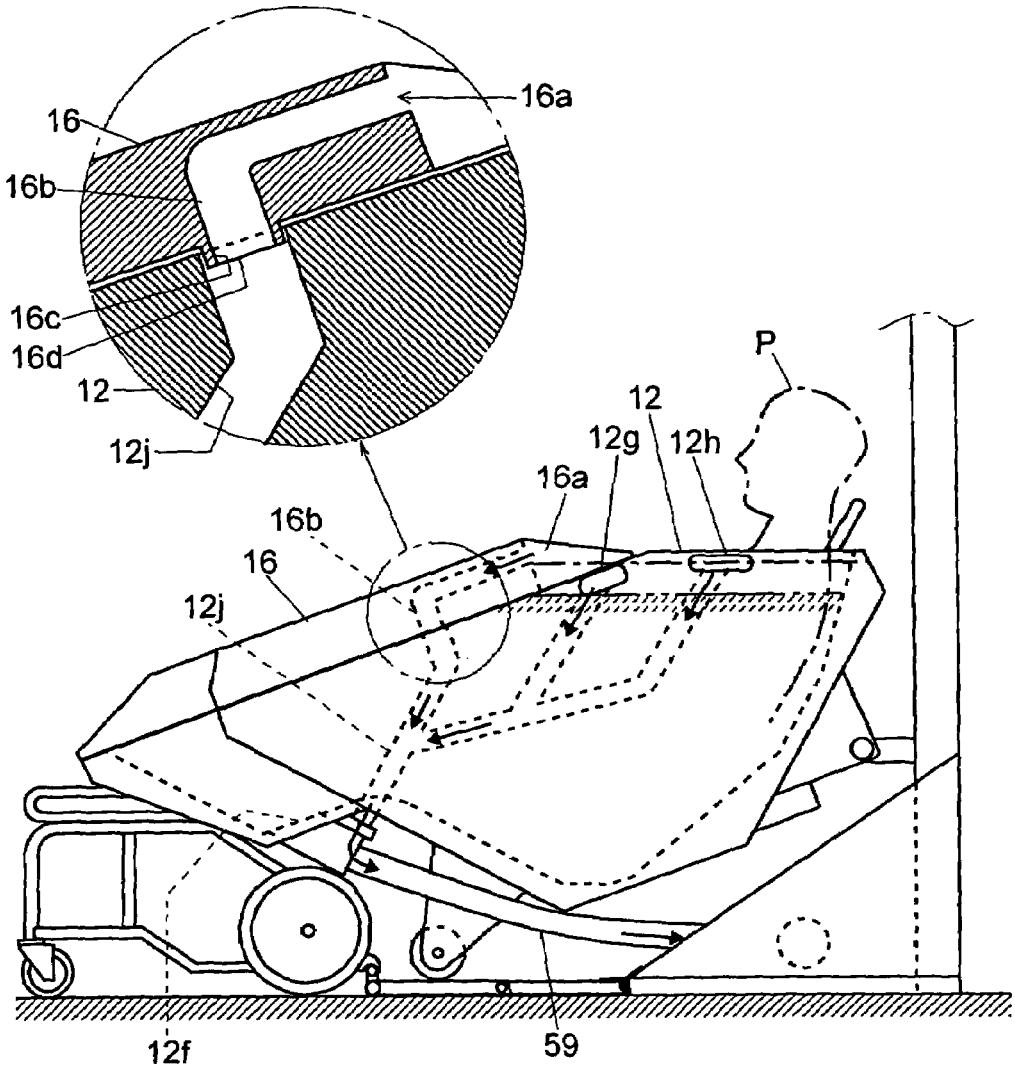
FIG. 18 is a side view of a drainage line of the bathing aid of the embodiment.

FIG. 15 is a diagram showing the piping for supplying and draining water in the present apparatus, FIGS. 16A and 16B are structural drawings showing the hot water supply line, and FIGS. 17 and 18 are side views showing the drainage lines.

In FIG. 15, the hot water supply line 40 leading to an external hot water supply system, and the water supply pipe 41 leading to a faucet, are connected to mixing valves (thermo-mixing valve) 42 and 43. The second mixing valve 43 mixes hot and cold water to produce hot water having an appropriate temperature. The hot water flows through the shower pipe 44 and is spouted from the showerhead 32. The first mixing valve 42 similarly produces hot water having an appropriate temperature, which is supplied through an electromagnetic valve 45 into the tank 11. The hot water is also supplied through the bypass pipe 46 having a bypass valve 47 to a hot water supply pipe 48.

The tank 11 has a hot water supply port leading to the hot water supply pipe 48 and a drainage port leading to a drainage pipe 49, both formed at the bottom of the tank 11. The two ports are provided with a hot-water supply valve 50 and a tank water drainage valve 52, which are opened or closed by the torque motors 51 and 53, respectively. As shown in FIGS. 16A and 16B, the hot-water supply valve 50 is composed of a hemispherical valve body 501, a chain 502 pulled by a pulley 503 according to the operation of the torque motor 51, and a communication pipe 504 for the communication between the space under the valve body 501 and the atmosphere.

When the torque motor 51 is energized to rotate the pulley 503 and pull the chain 502, the valve body 501 is pulled open against the water pressure. At this moment, air is introduced through the communication pipe 504 into the hot water supply pipe 48, so that the pressure in the hot water supply pipe 48 does not become negative. Therefore, the valve body 501 can be smoothly pulled up, allowing the hot water in the tank 11 to flow into the hot water supply pipe 48. When the torque motor 51 is stopped and, accordingly, the chain 502 is loosened, the valve body 501 is closed by the water pressure. At this moment, the air escapes from the hot water supply pipe 48 into the communication pipe 504, so that the valve body 501 assuredly closes the hot water supply port. It should be noted that the tank water drainage valve 52 operates in a similar way.

In the present apparatus, the hot-water supply valve 50 and the tank water drainage valve 52 are installed in the tank 11; no member of these valves are located outside the tank 11. This construction reduces the space occupied by the apparatus.

In the middle of the hot water supply pipe 48, the apparatus has a liquid dispenser for automatically injecting a body shampoo and/or bath agent into the hot water. In the present embodiment, the liquid dispenser consist of a bottle 55 for storing a liquid bath agent and a pump 56 for pumping the liquid from the bottle 55 into the hot water supply pipe 48. An example of the pump 56 is a tube pump having a tube containing a liquid, rollers for squeezing the tube so that the liquid is pushed in the rolling direction, and a motor for driving the rollers. The present apparatus has two liquid dispensers corresponding to the body shampoo and the bath agent, respectively. It is possible to construct a mechanism using a single pump and a clutch or similar device for selectively drawing and supplying a liquid from either the shampoo bottle or bath agent bottle. The hot water supplied through the hot water supply pipe 48 is spouted from the hot water supply port 12*e* into the bathtub 12.

The water stored in the bathtub 12 can be drained through the drainage port 12*f* located in the front part of the bottom of the bathtub 12. The drainage port 12*f* leads to an external drain ditch through a drainage pipe 59 that is contractible and expansible like a bellow. When the drainage valve 58 located close to the drainage port 12*f* is opened, the water in the bathtub 12 is drawn into the drainage pipe 59 and discharged to the outside. In the stored state (FIG. 1) or normal bathing state (FIG. 3), the drainage port 12*f* is not at the lowest level within the bathtub 12; it comes to the lowest level only when the bathtub 12 is in the setting state. Therefore, to completely drain the water from the bathtub 12, the drainage valve 58 must be opened in the setting state.

If the bathtub 12 overflows with the water during the water supply time or bathing time, the water will spill over onto the floor around the main unit 1. To avoid this situation, two overflow ports 12*g* and 12*h* are formed in the inner wall of the bathtub 12, as shown in FIG. 18. These overflow ports 12*g* and 12*f* lead to the drainage pipe 59 through the overflow pipe 12*j* formed in the sidewall of the bathtub 12. When the water in the bathtub 12 reaches a level higher than the overflow ports 12*g* and 12*h*, a part of the water enters the overflow ports 12*g* and 12*h*, flows through the overflow pipe 12*j* and the drainage pipe 59, and is discharged to the outside. The cover 16 is also provided with an overflow port 16*a*, which leads to an overflow pipe 16*b* formed in the cover 16. When the cover 16 is closed, the overflow pipe 16*b* is connected to the overflow pipe 12*j* of the bathtub 12. Thus, the overflow port 16*a* also leads to the drainage pipe 59.

The outlet 16*d* of the overflow pipe 16*b* of the cover 16 is connected to the inlet formed in the upper end of the bathtub 12, as shown in FIG. 18. The flange 16*c* at the circumference of the outlet 16*d* is designed to project into the inlet of the bathtub 12. This design ensures that the water spouted from the outlet 16*d* enters the overflow pipe 12*j*, being prevented from penetrating into the space between the cover 16 and the bathtub 12 leaking to the outside.

The present apparatus has an air pump 60 for generating bubbles. The air pump 60 supplies air into two pipes, one connected to a bubble generator 61 for sending air into the bathtub 12, and the other connected to a bubble generator 62 for sending air into the tank 11. The bubble generator 61 is used mainly for providing cleaning effect (or moderate massaging effect) on the body surface of the bather during bathing, and the bubble generator 62 is used for stirring the hot water in the tank 11 to equalize the temperature of the hot water.

In FIG. 15, temperature sensors 63, 64, 65, and 66, each consisting of a thermistor for detecting the temperature of the hot water, are located in the outlet of the first mixing valve 42, in the tank 11, in the hot water supply pipe 48 and in the bathtub 12, respectively. Furthermore, the tank 11 has a tank water level sensor 67 for determining whether the tank is full, and also the bathtub 12 has a bathtub water level sensor 68 for detecting the water level in the bathtub 12.

Figure 19:
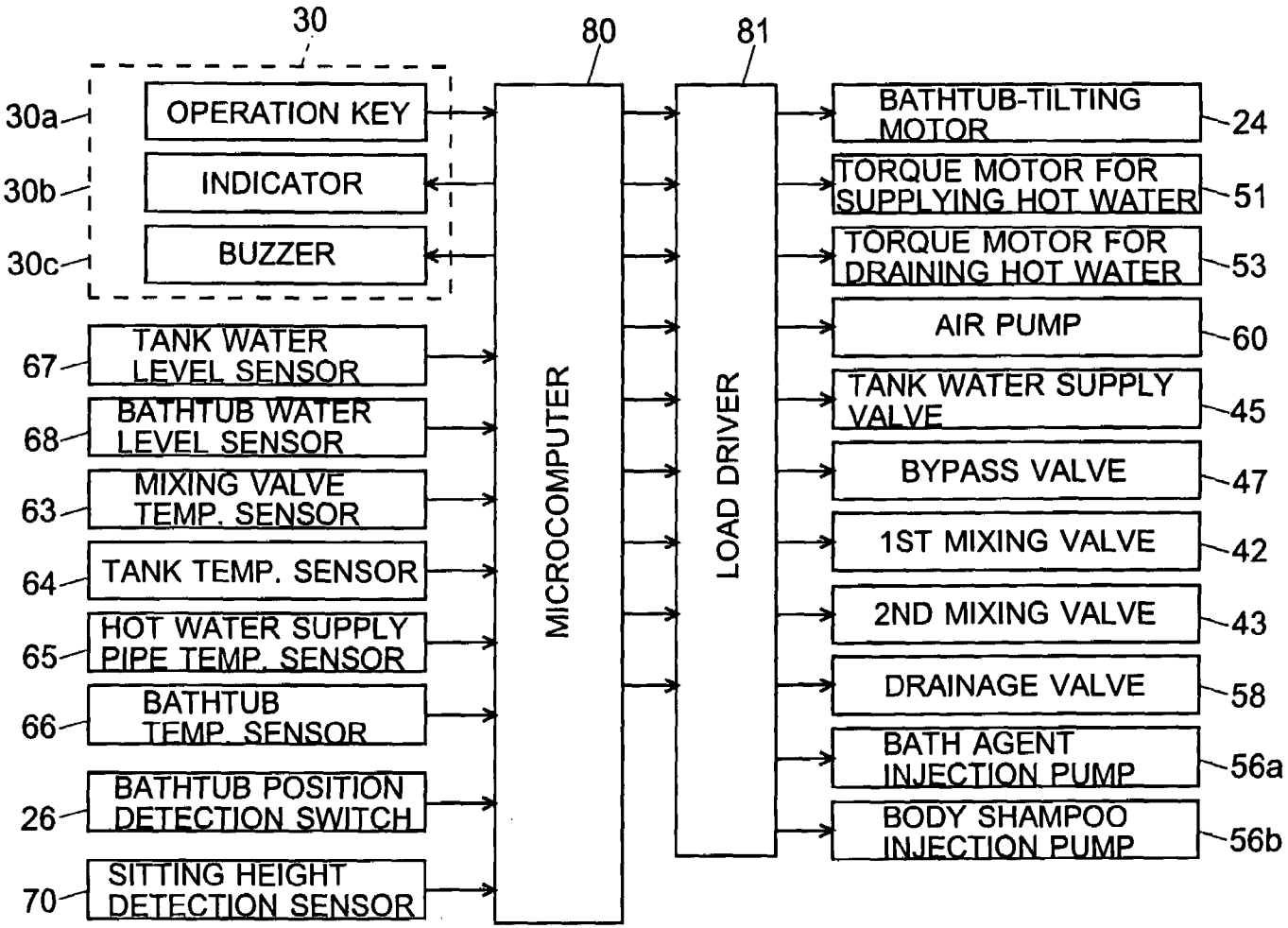
FIG. 19 shows the general construction of the electrical system of the bathing aid of the embodiment.

FIG. 19 shows the general construction of the electrical system of the present apparatus. The core of the system is a microcomputer 80, which receives various signals, including key input signals from various operation keys 30*a* of the operation panel 30, level detection signals from the tank water level sensor 67 and the bathtub water level sensor 68, temperature detection signals from the mixing valve temperature sensor 63, the tank temperature sensor 64, the supply pipe temperature sensor 65 and the bathtub temperature sensors 66, sitting height detection signals from the sitting height sensor 70, and bathtub position signals from the bathtub position detection switches 26. As is generally known, microcomputers has random access memory (RAMs) and read only memories (ROMs), and ROMs hold pre-installed control programs. With a control program running, the microcomputer 80 receives the aforementioned signals, and controls the load driver 81 to drive the following elements: the bathtub-tilting motor 24, the torque motor 51 for supplying hot water into the bathtub 12, the torque motors 53 for draining hot water from the tank 11, the air pump 60, the tank water supply valve 45 for controlling the hot water supply into the tank 11, the first mixing valve 42 for regulating the temperature of the hot water supplied into the tank 11, the bypass valve 47, the second mixing valve 43 for regulating the temperature of the hot water supplied to the showerhead, the drainage valve 58 for draining hot water from the bathtub 12, the bath agent injection pump 56*a* for injecting a bath agent into the hot water flowing into the bathtub 12, and the body shampoo injection pump 56*b* for injecting a body shampoo into the hot water flowing into the bathtub 12.

Figure 20:
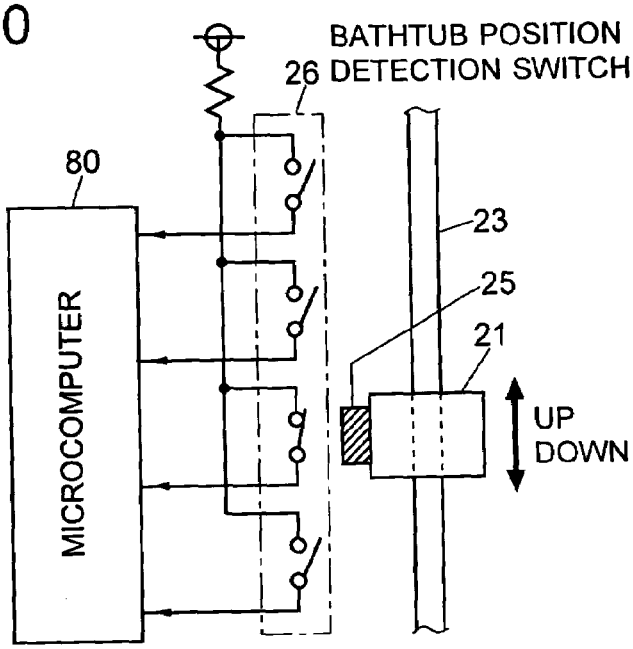
FIG. 20 is a circuit diagram showing the relation between the microcomputer and the bathtub position detection switches in the bathing aid of the embodiment.

FIG. 20 is a circuit diagram showing the relation between the microcomputer 80 and the bathtub position detection switches 26. The four bathtub position detection switches 26 depicted in FIG. 20 are the four reed switches depicted in FIG. 6.

Figure 21:
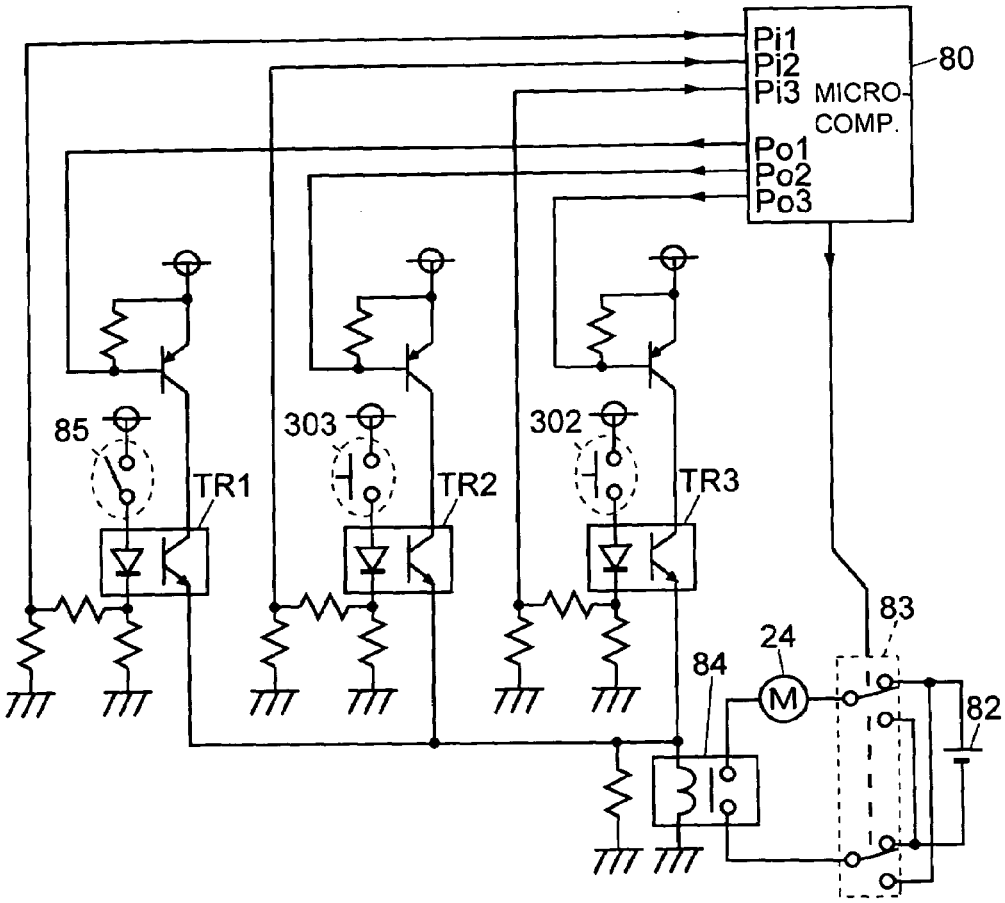
FIG. 21 is a circuit diagram of the main part relevant to the operation of the motor for tilting the bathtub in the bathing aid of the embodiment.

The present apparatus is designed so that it will never endanger the caregiver or other persons present by making abnormal operations even if the microcomputer 80 runaways due to an external noise or other factors while changing the orientation of the bathtub 12 between the stored state and the setting state. FIG. 21 is a circuit diagram of the main part relevant to the operation of the motor 24.

The motor 24 is connected to the power source 82 via an electromagnetic relay 84 and a polarity inversion switch 83. The polarity inversion switch 83 is switched by a control signal from the microcomputer 80. Switching of the polarity changes the rotating direction of the motor 24, which in turn changes the direction of the vertical movement of the bathtub 12 (or the movable unit 21). To the coil of the electromagnetic relay 84, three current supply circuits are connected in parallel; one circuit includes the setting key 302 and a third photo-coupler TR3, another circuit includes the storage key 303 and a second photo-coupler TR2, and the other circuit includes a switch 85 and a first photo-coupler TR1. When a current is supplied from one of the three circuits, the electromagnetic relay 84 turns ON and supplies a driving current to the motor 24.

Figure 22A:
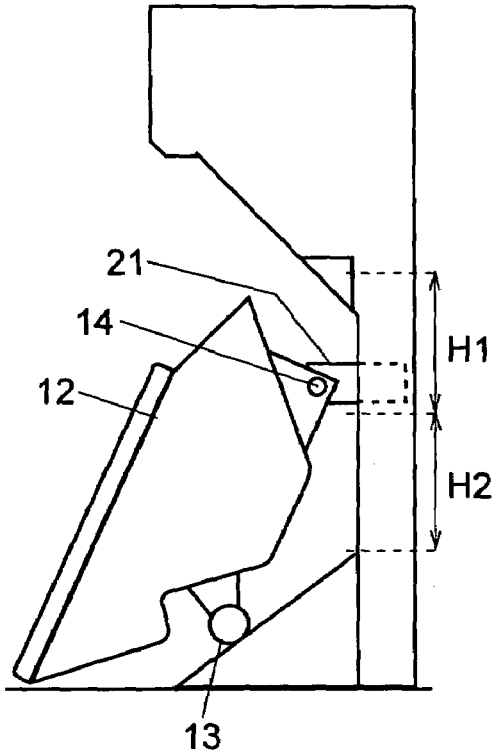
FIGS. 22A–22C show the construction of the switch shown in FIG. 21, where
Figure 22B:
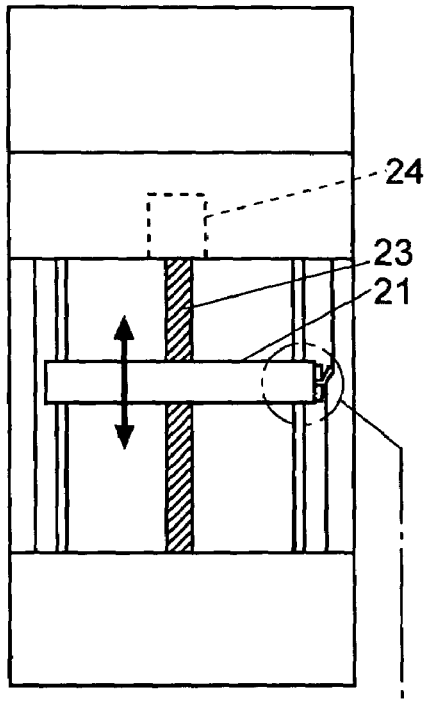
Figure 22C:
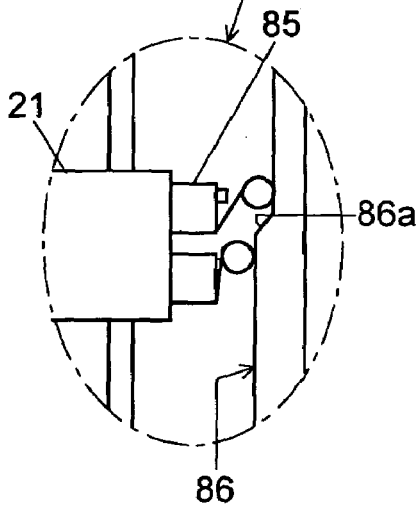

FIGS. 22A–22C show the construction of the switch 85 shown in FIG. 21, where FIG. 22A is a general side view of the main unit, FIG. 22B is a front view without the bathtub 12, and FIG. 22C is an enlarged view of a part of FIG. 22B. As shown in FIG. 22C, a guide wall 86 having a step 86*a* is formed one side of the pillar 10 located on one side of the movable unit 21 which moves vertically along the screw shaft 23. The movable element of the switch 85 fixed on the aforementioned side of the movable unit 21 receives no force from the guide wall 86 when it is higher than the step 86*a*, and receives a pressing force from the guide wall 86 when it is lower than the step 86*a*. In other words, the switch 85 is open when the movable unit 21 is higher than the step 86*a* (i.e. when it is within the range H1 in FIG. 22A), and is closed when the movable unit 21 is lower than the step 86*a* (i.e. when it is within the range H2 in FIG. 22A).

The opening/closing of the switch 85 can be checked by the signal coming from the input port Pi1 of the microcomputer 80. When the switch 85 is closed, the output transistor of the first photo-coupler TR1 is ON, so that the opening/closing of the electromagnetic relay 84 can be controlled by sending an output signal through the output port Po1, irrespective of whether the other two current supply circuits are working or not. This means that the microcomputer 80 can spontaneously control the operation of motor 24, or the tilting motion of the bathtub 12.

When the movable unit 21 is within the range H1 and the switch 85 is accordingly open, the output transistor of the photo-coupler TR1 is OFF, so that this current supply circuit is irrelevant to the opening/closing of the electromagnetic relay 84. The output transistors of the photo-couplers TR2 and TR3 included in the other two current supply circuits, on the other hand, turn ON only when the storage key 303 or the setting key 302 is pressed. Therefore, even when the microcomputer 80 supply a voltage to the output port Po2 or Po3 for supplying a current to the coil, the electromagnetic relay 84 never turns ON if neither the storage key 303 nor the setting key 302 is pressed at the moment. This means that, when the movable unit 21 is within the range H1, it is always necessary to manually press the storage key 303 or the setting key 302 to change the orientation of the bathtub 12. Thus, there is little possibility that an unsafe situation occurs due to an abnormal operation caused by a problem of the microcomputer 80 or other factors.

The motor 24 runs only during the period the storage key 303 or the setting key 302 is pressed. In the course of the tilting motion of the bathtub 12, if the caregiver feels some danger and releases the key, the bathtub 12 immediately stops. This is another aspect of the high level of safety ensured by the present apparatus.

When the movable unit 21 is within the range H2, the tilting motion of the bathtub 12 is controlled by the microcomputer 80. Normally, the maximally tilted position is the normal bathing state, as shown in FIG. 3, where the upper edge of the opening 12*b* of the bathtub 12 is almost horizontal. It is possible, however, that bathtub 12 goes beyond that position because of a runaway of the microcomputer 80 or breakage of mechanical parts such as the ball screw. To prevent this situation, the screw shaft 23 has a stopper 27 at its lower end, which mechanically stops the movable unit 21 and prevents it from further lowering.

In the present apparatus, an appropriate amount of hot water is stored in the bathtub 12, and the bather bathes in the hot water. When, for example, the hot water is intended to be stored up to the shoulder blades, the amount of necessary hot water varies depending on the body size of the bather, especially on the sitting height. Though the amount of the hot water can be determined as desired as described later, it is possible that the head of the bather submerges under water in the bathtub 12 if the bather has an extraordinarily short sitting height. Therefore, use of the present apparatus is limited to those who are more than about 140 cm tall. To take into account the personal difference in sitting height and other body size, and to further improve the safety, the present apparatus is provided with a sitting height detection sensor 70.

Figure 23A:
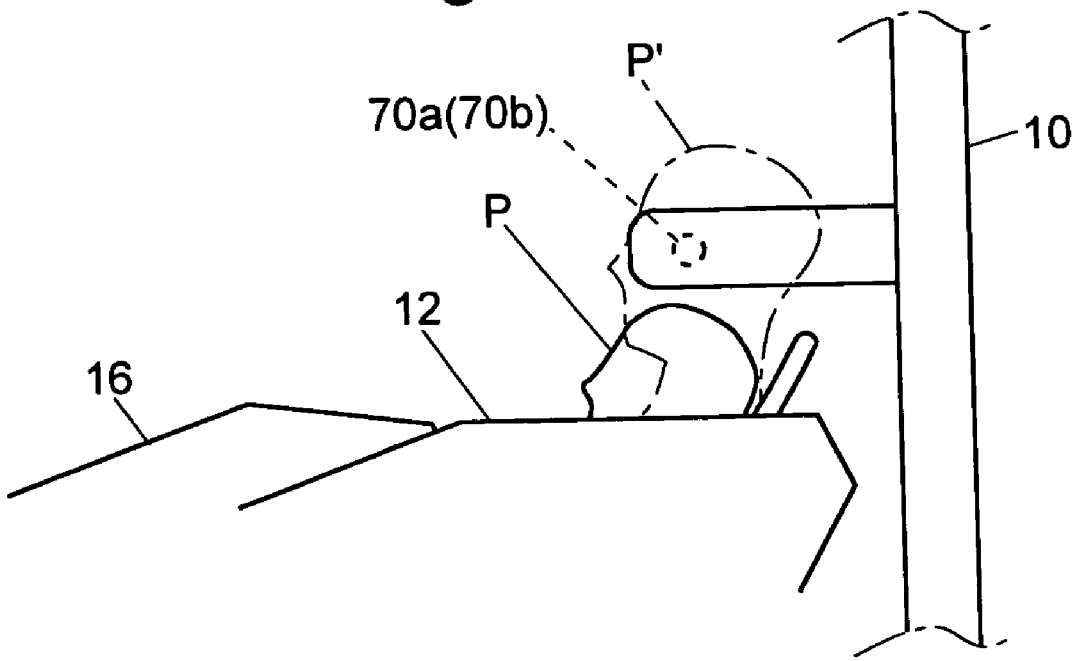
FIGS. 23A and 23B are outlined views of the main part of the sitting height detection sensor in the bathing aid of the embodiment, where
Figure 23B:
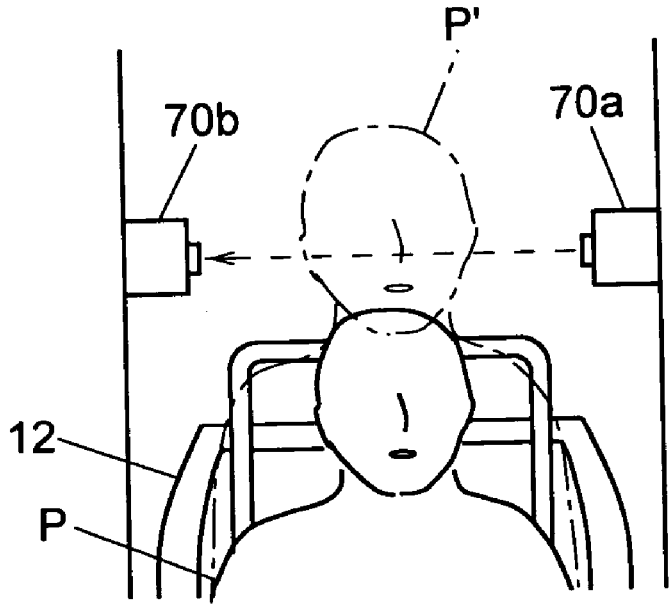
Figure 24:
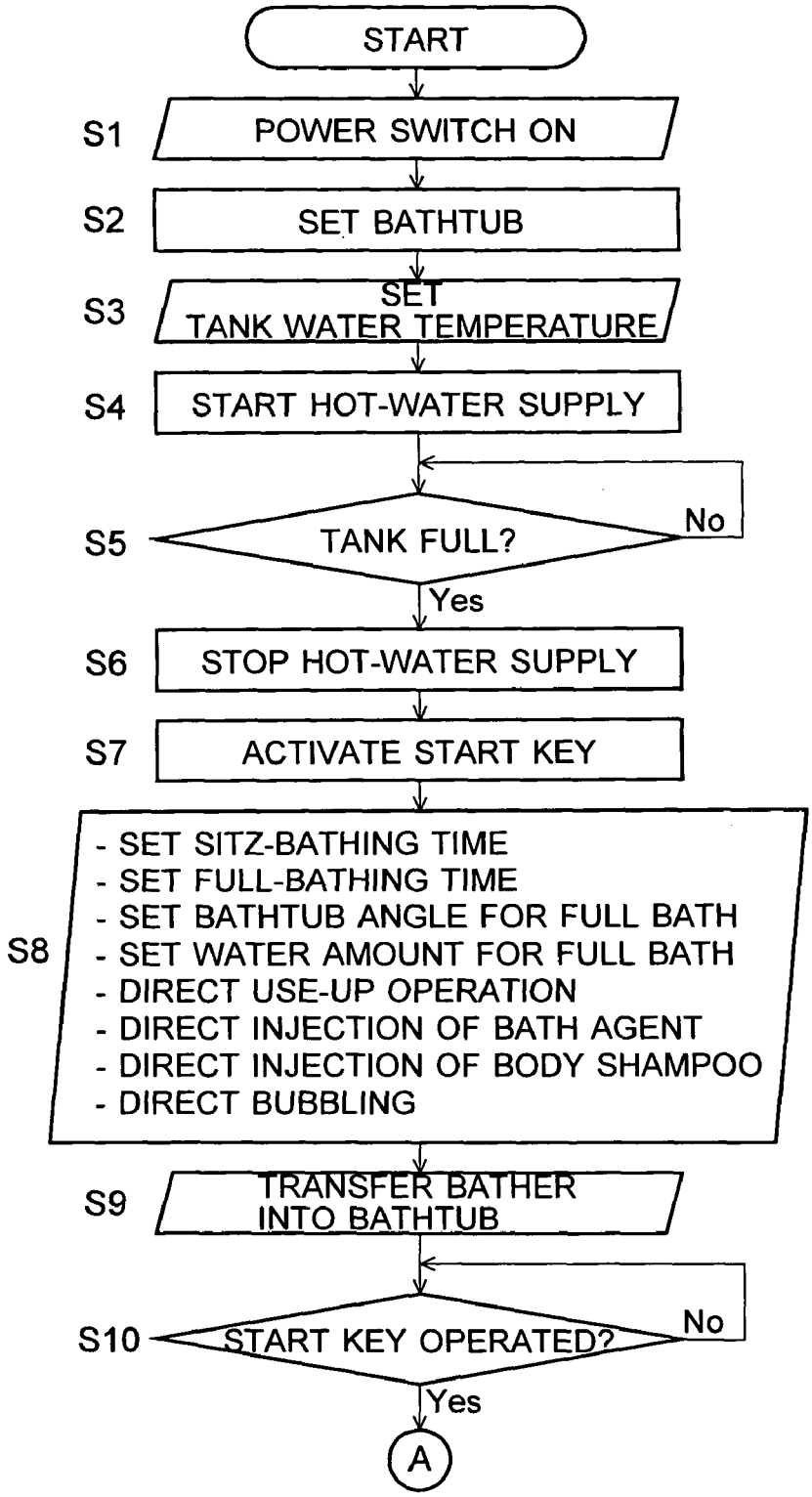
FIG. 24 is a flowchart showing the steps for caregivers to let a bather take a bath with the present bathing aid of the embodiment.
Figure 25:
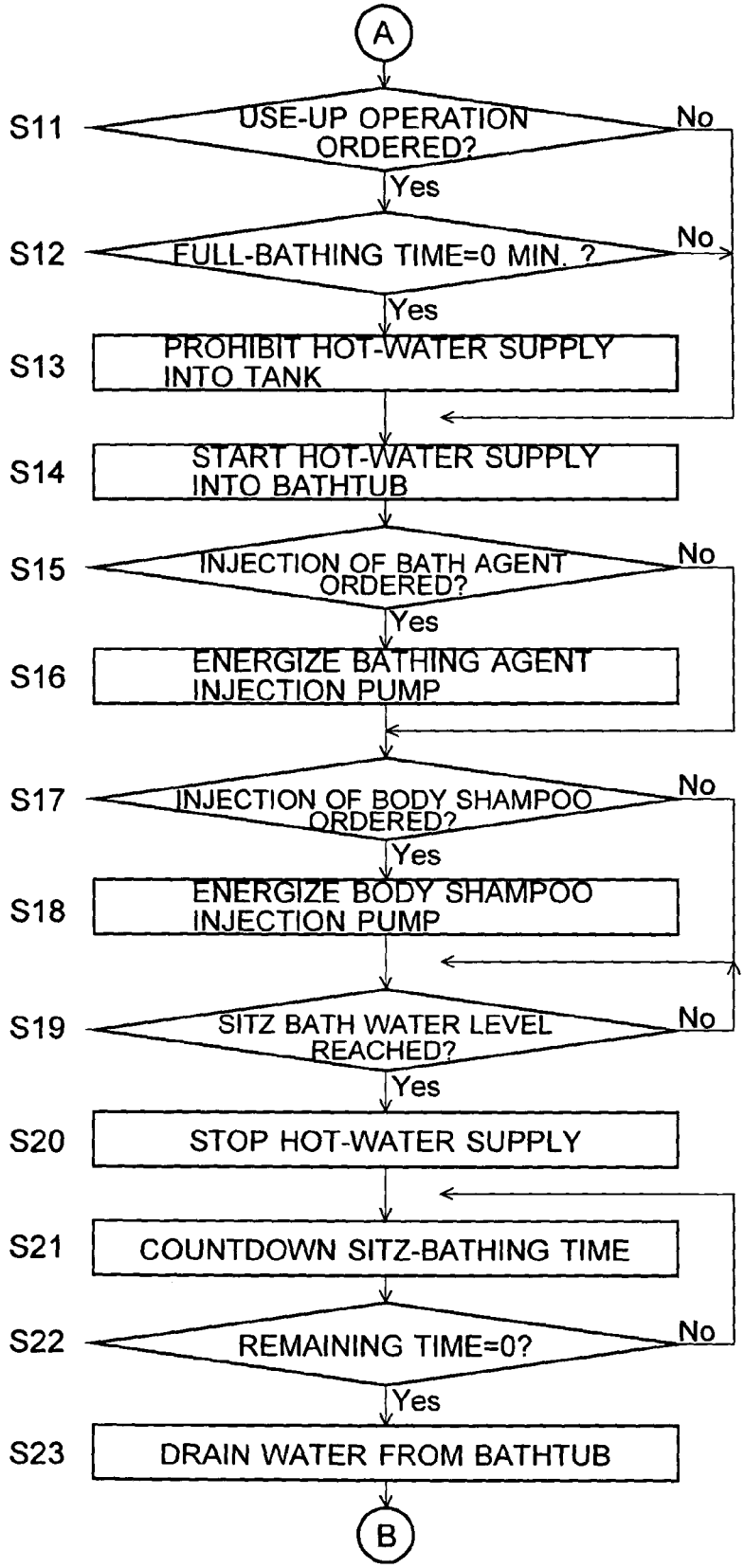
FIG. 25 is a flowchart showing the steps for caregivers to let a bather take a bath with the present bathing aid of the embodiment.
Figure 26:
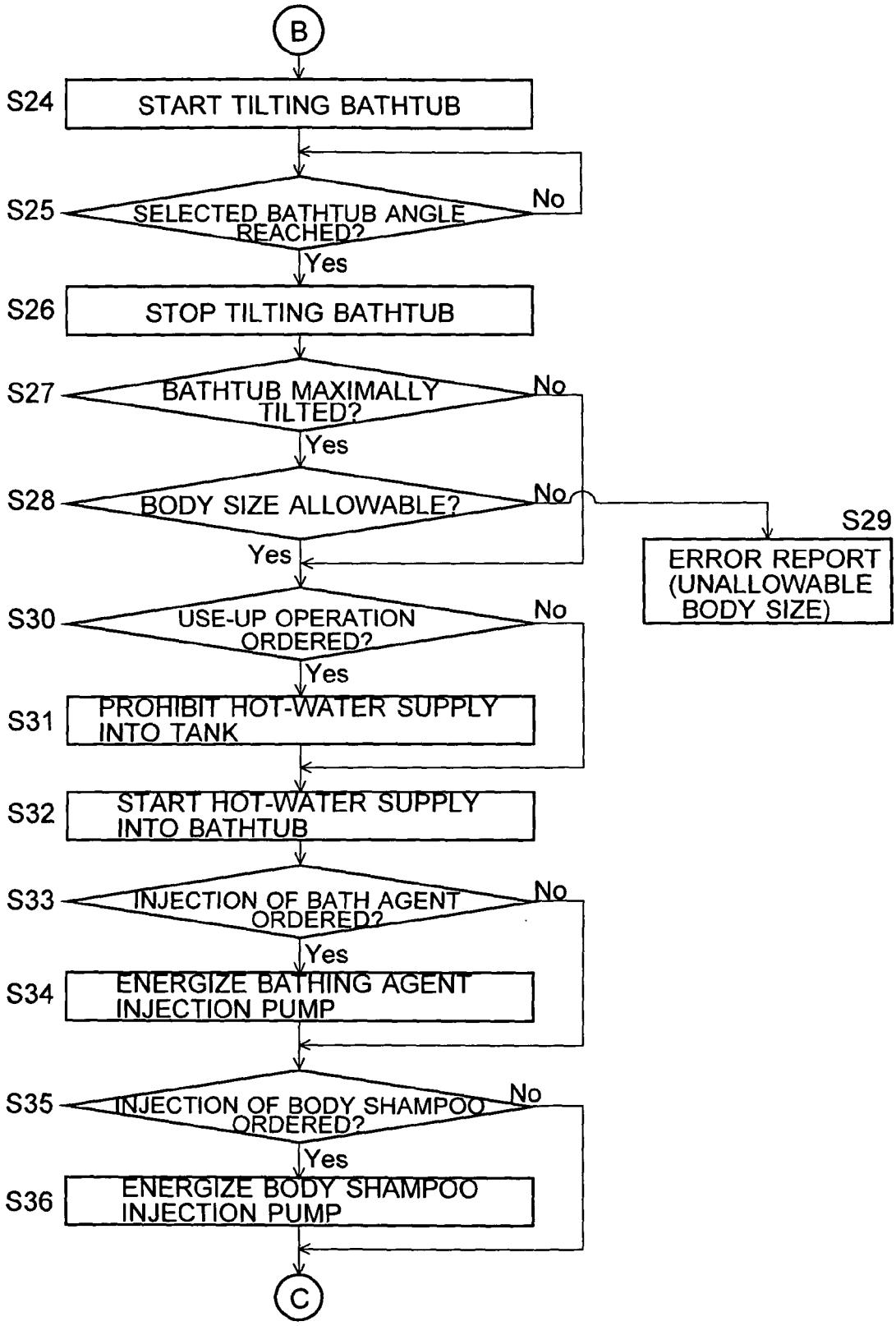
FIG. 26 is a flowchart showing the steps for caregivers to let a bather take a bath with the present bathing aid of the embodiment.
Figure 27:
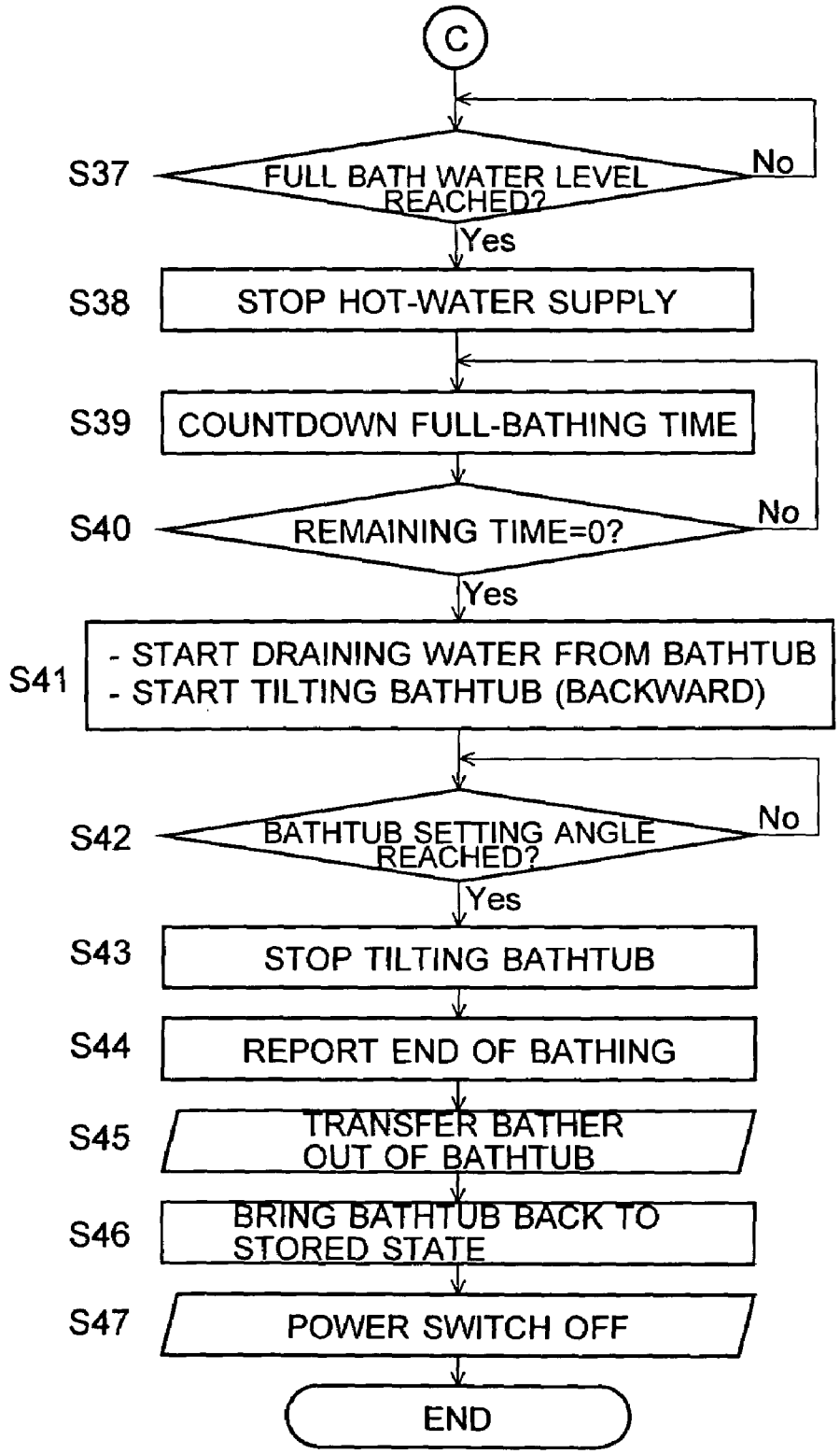
FIG. 27 is a flowchart showing the steps for caregivers to let a bather take a bath with the present bathing aid of the embodiment.

FIGS. 23A and 23B are outlined views of the main part of the sitting height detection sensor 70, where FIG. 23A is a side view and FIG. 23B is a front view. The sensor 70 includes an infrared emitter 70*a* and an infrared detector 70*b* located at both sides of the bather P or P' in the bathtub 12 at the level where the infrared beam emitted by the infrared emitter 70*a* is blocked by the head of the bather in the normal bathing state, as denoted by P' in FIGS. 23A and 23B, if the bather has an allowable body size. When the bather has an unallowable body size, as denoted by P in FIGS. 23A and 23B, the head does not block the infrared beam, which is accordingly detected by the infrared detector 70*b*. Thus, based on the detection signal of the infrared detector 70*b*, it is possible to automatically determine whether the bather has an allowable body size.

The operations of the present apparatus are described.

Referring to the flowcharts in FIGS. 24–27, the steps for caregivers to allow a bather take a bath with the present apparatus is described. It is assumed that the bathtub 12 of the apparatus is initially in the storage position, as shown in FIG. 1.

The caregiver presses the power switch 301 on the operation panel 30 of the main unit 1 to turn on the power (Step S1). Then, electric power is supplied to the microcomputer 80 and other electrical circuits, and a predetermined control program is executed on the microcomputer 80. The program performs an initializing process, in which the setting key 302 is enabled. When the caregiver presses the setting key 302, the load driver 81 drives the bathtub tilting motor 24 while the key 302 is pressed. The rotation of the motor 24 produces the downward motion of the movable unit 21, which in turn drives the bathtub 12 to tilt toward the position where the open top 12*a* is directed upward. The motor 24 is stopped when the bathtub 12 has reached the predetermined setting position. Thus the setting process is completed (Step S2).

Next, the caregiver appropriately sets the temperature of the hot water, using the tank water temperature setting key 306 (Step S3). In response to this operation, the tank water supply valve 45 is opened to start supplying hot water into the tank 11, while regulating the mixing ratio of the hot and cold water with the first mixing valve 42 (Step S4). When a signal from the tank water level sensor 67 is detected, the tank is full of water, so that the tank water supply valve 45 is closed to stop supplying hot water into the tank 11 (Steps S5, S6). After the water supply is stopped, the operation keys are enabled (Step S7). Now, the caregiver can use the bathing time setting keys 309 to set the bathing time for "sitz bath" or "full bath", the bathtub angle setting key 310 to set the bathtub angle for full bath, and the water amount setting key 311 to set the amount of hot water for full bath. If necessary, the caregiver may use the use-up key 317 to order the use-up operation (which will be described later), the bath agent injection key 316 to order automatic injection of a bath agent, the body shampoo injection key 318 to order automatic injection of a body shampoo, and/or the bubbling key 313 to order the use of the bubbling (Step S8).

After making all the necessary settings, the caregiver transfers the bather P into the bathtub 12, and closes the cover 16 (Step S9). For example, a bather P lying on a bed is helped into the seat unit of the wheelchair 2, which is moved toward the bathtub 12 from the front, and the bogie unit 210 is temporarily fastened to the main unit 1. From this state, the seat unit 220 with the bather P sitting thereon is slid back toward the main unit 1, and transferred into the bathtub 12. After the bather P is completely transferred into the bathtub 12, the cover 16 is closed and locked. Thus, the bathtub 12 is tightly closed by the cover 16, with the head of the bather P sticking out through the opening 12*b*.

The above-described steps correspond to the preparation for bathing and include various jobs to be done by the caregiver. After that, the present apparatus performs an automatic operations relating to the bathing. To start the operation, the caregiver presses the start key 308 (Step S10). In response to this key operation, the microcomputer 80 checks whether the use-up operation is ordered (Step S11). The use-up operation uses up the hot water in the tank 11, on the assumption that nobody else will bathe after the current bather.

When the use-up operation is ordered, it is determined whether the full-bathing time is set zero minutes (Step S12). In a use-up operation, when the full-bathing time is set zero, meaning that the bathing mode is the "sitz bath," it is not necessary to refill the tank 11 after supplying the hot water into the bathtub 12. Therefore, the water supply into the tank 11 is prohibited (Step S13). On the other hand, when the use-up operation is not ordered, or when the use-up operation is ordered and the full-bathing time is not zero, the process goes to Step S14, where the torque motor 51 for supplying hot water is energized to open the hot-water supply valve 50 to start supplying hot water from the tank 11 into the bathtub 12. If the water supply into the tank 11 has not been prohibited in Step S13, the tank 11 is supplied with additional hot water to make up for the hot water supplied from the tank 11 into the bathtub 12. This mechanism will be described later.

After the start of the hot water supply, it is determined whether the injection of the bath agent is ordered (Step S15). When the injection of the bath agent is ordered, the bath agent injection pump 56*a* is energized (Step S16). It is also determined whether the injection of the body shampoo is ordered (Step S17), and the body shampoo injection pump 56*b* is energized if the injection of the body shampoo is ordered (Step S18). The bath agent injection pump 56*a* and the body shampoo injection pump 56*b* take in the bath agent and/or body shampoo held beforehand in the containers, and inject it into the hot water supply pipe 48. At the moment the hot water is spouted into the bathtub 12, the hot water is already mixed with the bath agent and/or body shampoo. As the hot water is collected in the bathtub 12, the water level in the bathtub 12 gradually increases.

The microcomputer 80 monitors the water level in the bathtub 12 with the bathtub water level sensor 68. When the water has reached a predetermined level for sitz bath ("Yes" in Step S19), the hot-water supply valve 50 is closed to stop supplying the hot water (Step S20). At this moment, the water level is such that the body of the bather P in the bathtub 12 is immersed up to the waist. Then, the countdown of the sitz-bathing time initially set by the caregiver is started, which is continued until the remaining time runs out (Steps S21, S22). When the sitz-bathing time has run out, the drainage valve 58 is opened to discharge the hot water from the bathtub 12 (Step S23). In the case of the sitz bath mode, the bathtub 12 is in the setting state, as shown in FIG. 17, and the drainage port 12*f* is at the lowest point within the bathtub 12. Therefore, the water is completely drained from the bathtub 12.

Next, the microcomputer 80 again drives the bathtub tilting motor 24 through the load driver 81 to further tilt the bathtub 12 (Step S24). When the bathtub 12 has reached the bathtub angle that the caregiver has initially selected from the predetermined four bathtub angles ("Yes" in Step S25), the motor 24 is halted to stop the tilting motion of the bathtub 12 (Step S26). After that, it is determined whether the tilt angle of the bathtub 12 is maximal, i.e. whether the bathtub 12 is in the normal bathing state shown in FIG. 3 (Step S27). If the tilt angle is maximal, it is determined whether the body size, or sitting height, of the bather P is allowable for using the present apparatus, based on the detection signal from the sitting height sensor 70 (Step S28).

As described above, the present apparatus automatically supplies hot water into the bathtub 12, irrespective of the body size of the bather. Therefore, even with the minimal level of hot water in the bathtub 12, a portion of the bather's face may be immersed under the water when the bathtub 12 is at the maximal tilt angle, if the bather has a very short sitting height. Taking this into account, the body size of the bather is checked in Step S28. If the body size is not allowable, the error is reported to the caregiver with the buzzer 30*c* or other devices (Step S29). Thus, very high degree of safety is achieved.

When the body size of the bather P is allowable, it is determined whether the use-up operation is ordered (Step S30). When the use-up operation is ordered, it is not necessary to refill the tank 11 after supplying the hot water into the bathtub 12. Therefore, the water supply into the tank 11 is prohibited (Step S31). On the other hand, when the use-up operation is not ordered, or when the use-up operation is ordered and the full-bathing time is not set zero, the process goes to Step S32, where the torque motor 51 for supplying hot water is energized to open the hot-water supply valve 50 to start supplying hot water into the tank 11. If the water supply into the tank 11 has not been prohibited in Step S13, the tank 11 is supplied with additional hot water to make up for the hot water supplied from the tank 11 into the bathtub 12.

Next, similar to Steps S15–S18, the process goes through Steps S33–S36, where the bath agent and/or body shampoo is injected into the hot water flowing into the bathtub 12, if it is directed. Then, the microcomputer 80 monitors the water level in the bathtub 12 with the bathtub water level sensor 68. When the water level has reached a predetermined level for a full bath ("Yes" in Step S37), the hot-water supply valve 50 is closed to stop supplying the hot water (Step S38). Then, the countdown of the full-bathing time initially set by the caregiver is started, which is continued until the remaining time runs out (Steps S39, S40). When the sitz-bathing time has run out, the drainage valve 58 is opened to start discharging the hot water from the bathtub 12, and the bathtub tilting motor 24 is driven to return the bathtub 12 to the setting position (Step S41).

When the bathtub 12 has returned to the setting position ("Yes" in Step S42), the motor 24 is halted to stop the tilting motion of the bathtub 12 (Step S43). In the full-bathing position, the drainage port 12*f* of the bathtub 12 is not at the lowest point. In the setting position, on the other hand, the drainage port 12*f* is at the lowest position within the bathtub 12. Therefore, after a certain period of time from the returning of the bathtub 12 to the setting position, the water is completely drained from the bathtub 12. Then, the completion of the bathing is reported to the caregiver with the buzzer 30*c* or other devices (Step S44), so that the caregiver can immediately notice the completion of the bathing even when she or he is away from the apparatus, and the bather P will never be left unattended after the completion of the bathing.

After that, following the steps of transferring the bather P into the bathtub 12 in reverse, the caregiver slides the seat unit 220 with the bather P sitting thereon from the bathtub 12 to the bogie unit 210 of the wheelchair 2. Then, the caregiver releases the wheelchair 2 from the temporary locked state, and moves it away from the main unit 1 (Step S45). If there is another bather waiting, the process should return to Step S8 (if it is necessary to change the setting) or S9. If there is no other bather, the caregiver presses the storage key 303 to move the bathtub 12 back to the stored state. As explained above, the bathtub tilting motor 24 is driven only while the storage key 303 is being pressed. In this process, the supportive shaft 14 pulls the rear end of the bathtub 12 up to the storage position (Step S46). When the bathtub 24 has reached the storage position, the motor 24 is stopped; it will no longer work even if the storage key 303 is pressed. Finally, the caregiver presses the power switch 301 to turn off the main unit 1 (Step S47). Thus, all of the tasks relating to bathing are completed.

[Regulating the Temperature of Hot Water Supplied through the Bypass Pipe]

Figure 28:
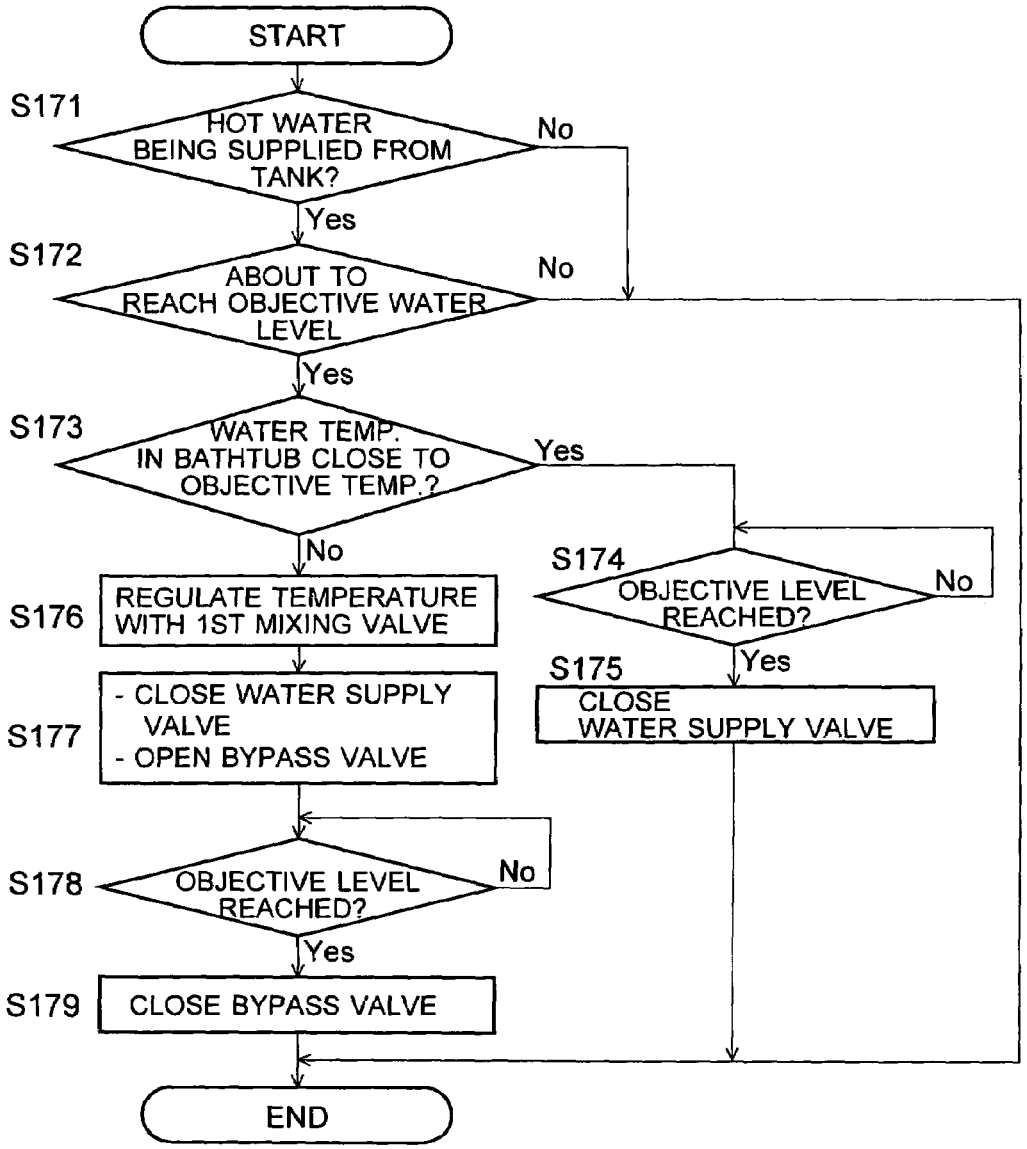
FIG. 28 is a flowchart showing the control steps of regulating the temperature of the hot water supplied through a bypass pipe.

The bathtub 12 is normally supplied with the hot water stored in the tank 11. When the temperature of the hot water being supplied into the bathtub 12 is lower than expected, hot water having a higher temperature can be supplied through the bypass into the bathtub 12, bypassing the tank 11. FIG. 28 is a flowchart showing the steps of controlling the temperature of the hot water supplied through the bypass pipe.

The microcomputer 80 determines whether hot water is being supplied from the tank 11 into the bathtub 12 (Step S171). If the hot water is being supplied, it is determined whether the current water level is about to reach the objective level (Step S172). If the water level is not about to reach the objective level, the process immediately ends without performing the operations described later, because supplying hot water having a relatively high temperature may make the water in the bathtub 12 too hot. If the water level is about to reach the objective level, the temperature of the hot water in the bathtub 12 is detected from the detection signal received from the bathtub temperature sensor 66, and then it is determined whether the detected temperature is close to the objective temperature (Step S173). If the detected temperature is close to the objective temperature, the hot-water supply from the tank 11 is continued, because supplying hot water through the bypass pipe 46 may make the water in the bathtub 12 too hot. When the water has reached the objective level ("Yes" in Step S174), the hot-supply valve 50 is closed (Step S175).

If, in Step S173, the detected temperature is not close to the objective temperature, i.e. if the detected temperature is to a certain extent lower than the objective temperature, the first mixing valve 42 is set for an appropriate water temperature (Step S176), the hot-water supply valve 50 is closed and the bypass valve 47 is opened (Step S177). As a result, the water flow from the tank 11 into the hot water supply pipe 48 is stopped, and the hot-water supply through the bypass pipe 46 is started. This time, since the hot water does not pass through the tank 11, the temperature of the hot water is almost the same as the temperature regulated by the mixing valve 42. To supply hot water having a slightly higher temperature into the bathtub 12, the temperature regulated by the mixing valve 42 should be set higher than the objective temperature by one to several degrees centigrade. When the water level in the bathtub 12 has reached the objective level ("Yes" in Step S178), the bypass valve 47 is closed to stop the hot-water supply (Step S179).

Finally, it should be noted that the above embodiment is an example of the present invention, and may be changed or modified within the spirit and scope of the present invention.

What is claimed is:

1. A bathing aid, comprising:

a wheelchair separable into a seat unit for a bather to sit down on and a bogie unit located under the seat unit;

a bathtub having an open top for receiving the seat unit with the bather sitting thereon and a drainage port for draining hot water from the bathtub;

a cover for closing the open top of the bathtub except for an opening for allowing the bather to stick the head through; and an overflow prevention mechanism having an overflow port located on a surface of the cover facing the bathtub, a cover-side overflow pipe extending from the overflow port through a body of the cover, and a bathtub-side overflow pipe, one end of which is connected to the cover-side overflow pipe when the cover is closed and the other end of which leads to either the drainage port or an external drainage pipe.

2. A bathing aid, comprising:

a wheelchair separable into a seat unit for a bather to sit down on and a bogie unit located under the seat unit;

a bathtub having an open top for receiving the seat unit with the bather sitting thereon;

a bathtub actuator having a motor, a vertical screw shaft rotated by the motor, and a movable unit having a ball screw engaged with the screw shaft and vertically moving with a rotation of the screw shaft; and a bathtub supporter having a supportive shaft mounted on the movable unit for supporting a rear part of the bathtub, a set of wheels located under a bottom of the bathtub at a position closer to a front than the supportive shaft, and a guide slope descending frontward, on which the set of wheels runs, whereby a vertical motion of the movable unit in the bathtub actuator produces a vertical motion of the rear end of the bathtub through the supportive shaft, with the set of wheels moving up or down along the guide slope, which changes the orientation of the bathtub so that the direction of the open top changes between an upward direction and a frontward direction.

3. The bathing aid according to claim 2, wherein at least one wheel of the set of wheels is located inward of either sidewall of the bathtub.

4. The bathing aid according to claim 2, wherein the motor is used to bring the bathtub one of three states including: a storage state where the open top of the bathtub is directed almost frontward; a setting state where a front edge of the bathtub is located close to a floor and the open top of the bathtub is directed obliquely frontward, allowing the bather to be transferred into or out of the bathtub; and a normal bathing state where the open top of the bathtub is directed almost upward.

5. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that a direction of the open top changes between an upward direction and a frontward direction; and an expansible bogie-fastening element to which a predetermined part of the bogie unit is fastened for temporarily fixing the bogie unit, which element changes its position with a motion of the bathtub so that it retreats backward when the bathtub is moved toward an upright position while it expands forward when the bathtub is pushed forward, whereby the bathtub has a set of wheels located under the bottom thereof that runs when the bathtub changes its orientation, and the bogie-fastening element expands forward when the set of wheels comes onto the bogie-fastening element and exerts a pressure thereon from above, whereas the bogie-fastening element stands up and retreats backward when it is released from the pressure exerted by the set of wheels.

6. A bathing aid, including:

a wheelchair separable into a seat unit for a bather to sit down on and a bogie unit located under the seat unit, and a bathtub having an open top for receiving the seat unit with the bather sitting thereon, whereby the seat unit of the wheelchair with the bather sitting thereon is transferred into the bathtub, and then hot water is supplied into the bathtub, wherein the seat unit has a set of first wheels running on a bogie-side guide rail located in the bogie unit and a set of second wheels running on a bathtub-side guide rail located in the bathtub, where the set of first wheels is free from contact with the bathtub-side guide rail and the set of second wheels is free from contact with the bogie-side guide rail.

7. The bathing aid according to claim 6, wherein the bogie-side guide rail has two cylindrical rail elements, one located parallel to and above the other, the set of first wheels is composed of a disk-shaped core clamped by an outer and inner disks each having a diameter greater than that of the core, and when the set of first wheels runs on the bogie-side guide rail, the core rolls in a space between the two rail elements, with the outer and inner disks clamping the two rail elements from both sides.

8. The bathing aid according to claim 6, wherein the bogie-side guide rail has a surface for the set of first wheels to run on, and an end part of the surface has an inclined profile that descends toward an end of the rail to be pointed to the bathtub when the bather is transferred into the bathtub.

* * * * *